US012545535B2

(12) United States Patent
Iwami et al.

(10) Patent No.: US 12,545,535 B2
(45) Date of Patent: Feb. 10, 2026

(54) IMAGE FORMING APPARATUS

(71) Applicant: CANON KABUSHIKI KAISHA, Tokyo (JP)

(72) Inventors: Shingo Iwami, Tokyo (JP); Hiroto Koga, Chiba (JP); Toshifumi Itabashi, Ibaraki (JP); Kozo Inoue, Chiba (JP); Hiroyuki Nakagawa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 204 days.

(21) Appl. No.: 18/309,961

(22) Filed: May 1, 2023

(65) Prior Publication Data

US 2023/0382669 A1 Nov. 30, 2023

(30) Foreign Application Priority Data

May 31, 2022 (JP) ..... 2022-088746
Mar. 31, 2023 (JP) ..... 2023-058759

(51) Int. Cl.
*B65H 3/48* (2006.01)
*B65H 3/08* (2006.01)

(52) U.S. Cl.
CPC ..... *B65H 3/08* (2013.01); *B65H 2405/114* (2013.01); *B65H 2406/10* (2013.01)

(58) Field of Classification Search
CPC ..... G03G 15/6511; B65H 1/04; B65H 2405/114; B65H 2406/10; B65H 2406/121; B65H 2406/1211; B65H 2406/122; B65H 2801/03; B65H 2801/06
USPC ..... 271/97
See application file for complete search history.

(56) References Cited

U.S. PATENT DOCUMENTS 7,364,150 B2 * 4/2008 Nakane ..... B65H 3/128 271/97
7,549,629 B2 6/2009 Tateishi
7,641,188 B2 1/2010 Hiura
7,748,697 B2 7/2010 Fujita
7,900,909 B2 3/2011 Hiura
8,074,978 B2 * 12/2011 Takahashi ..... B65H 3/48 271/97
8,238,778 B2 8/2012 Itabashi
(Continued)

FOREIGN PATENT DOCUMENTS

EP 2119652 A2 11/2009
JP 2005-335885 A 12/2005
(Continued)

OTHER PUBLICATIONS

Oct. 12, 2023 European Official Action in European Patent Appln. No. 23169692.3.

*Primary Examiner* — Leslie A Nicholson, III
(74) *Attorney, Agent, or Firm* — Venable LLP

(57) ABSTRACT

An image forming apparatus includes an image forming portion, a tray rotatably provided on a side surface of a main assembly and including a stacking surface, a feeding portion; and a blowing fan mounted on the tray and generating air blown to a side end of a sheet in a sheet widthwise direction perpendicular to a feeding direction of the sheet by the feeding portion. The blowing fan is disposed on an opposite side to a side where the sheet is stacked on the stacking surface so that a position of at least a part of the blowing fan with respect to the sheet widthwise direction is overlapped with a position of the stacking surface with respect to the sheet widthwise direction.

40 Claims, 18 Drawing Sheets

(56) References Cited

U.S. PATENT DOCUMENTS

| | | | | |
|---|---|---|---|---|
| 8,246,039 | B2 | 8/2012 | Koga | |
| 8,459,635 | B2 | 6/2013 | Inoue | |
| 8,511,674 | B2 | 8/2013 | Koga | |
| 8,727,343 | B2 * | 5/2014 | Sakamoto | B65H 1/04 271/96 |
| 8,979,088 | B2 | 3/2015 | Itabashi | |
| 9,272,861 | B2 | 3/2016 | Tateishi | |
| 9,452,902 | B2 | 9/2016 | Koga | |
| 9,860,403 | B2 | 1/2018 | Matsumoto | |
| 9,908,727 | B2 | 3/2018 | Iwami | |
| 9,994,405 | B2 | 6/2018 | Itabashi | |
| 10,207,883 | B2 | 2/2019 | Inoue | |
| 10,308,453 | B2 | 6/2019 | Inoue | |
| 11,334,015 | B2 | 5/2022 | Itabashi | |
| 11,572,240 | B2 | 2/2023 | Koga | |
| 2013/0087967 | A1 | 4/2013 | Fuda | |
| 2013/0320613 | A1 | 12/2013 | Sakamoto | |
| 2022/0082971 | A1 | 3/2022 | Koga | |
| 2022/0227596 | A1 | 7/2022 | Chiba | |
| 2022/0388795 | A1 * | 12/2022 | Konishi | B65H 1/04 |

FOREIGN PATENT DOCUMENTS

| | | | |
|---|---|---|---|
| JP | 2006-256819 | A | 9/2006 |
| JP | 2008-087906 | A | 4/2008 |

* cited by examiner (a)

(b)

IMAGE FORMING APPARATUS

FIELD OF THE INVENTION AND RELATED ART

The present invention relates to an image forming apparatus forming an image on a sheet.

In recent years, it is increasingly demanded even for an electrophotographic image forming apparatuses used in offices to produce high-quality and high image quality results using special papers such as a coated paper and a thick paper. However, because of a reason that these special papers have a high smoothness of a surface and a sticking is likely to occur between the sheets, etc., it is more difficult to separate and feed sheets one by one from a sheet bundle in a state of stacking than an ordinary plain paper or a recycled paper for office use.

Japanese Patent Laid-open No. 2006-256819 discloses an art to help separate the sheets by blowing air on side ends of a sheet bundle set on a manual feed tray. However, in a configuration of the above document, a blower is protruded outside of a sheet stacking region on the manual feed tray, and thereby making a device larger for a space required to dispose the blower.

SUMMARY OF THE INVENTION

The present invention makes possible to save space in a configuration that blows air to the sheet.

One aspect of the present invention is an image forming apparatus comprising, an image forming portion configured to form an image on a sheet, a tray rotatably provided on a side surface of a main assembly accommodating the image forming portion and including a stacking surface on which the sheet is stacked, a feeding portion configured to feed the sheet stacked on the stacking surface toward the image forming portion, and a blowing fan mounted on the tray and configured to generate air blown to a side end of the sheet with respect to a sheet widthwise direction perpendicular to a feeding direction of the sheet by the feeding portion, wherein the blowing fan is disposed on an opposite side to a side where the sheet is stacked on the stacking surface so that a position of at least a part of the blowing fan with respect to the sheet widthwise direction is overlapped with a position of the stacking surface with respect to the sheet widthwise direction.

Further features of the present invention will become apparent from the following description of exemplary embodiments with reference to the attached drawings.

DESCRIPTION OF THE EMBODIMENTS

Hereinafter, Embodiments according to the present disclosure will be described with reference to the drawings.

In the present disclosure, an "image forming apparatus" refers to an apparatus forming an image on a sheet as a recording material. The image forming apparatus includes a printer, a copy machine, a multifunctional machine, a commercial printing machine, etc.

Embodiment 1

(Image Forming Apparatus)

Figure 1:
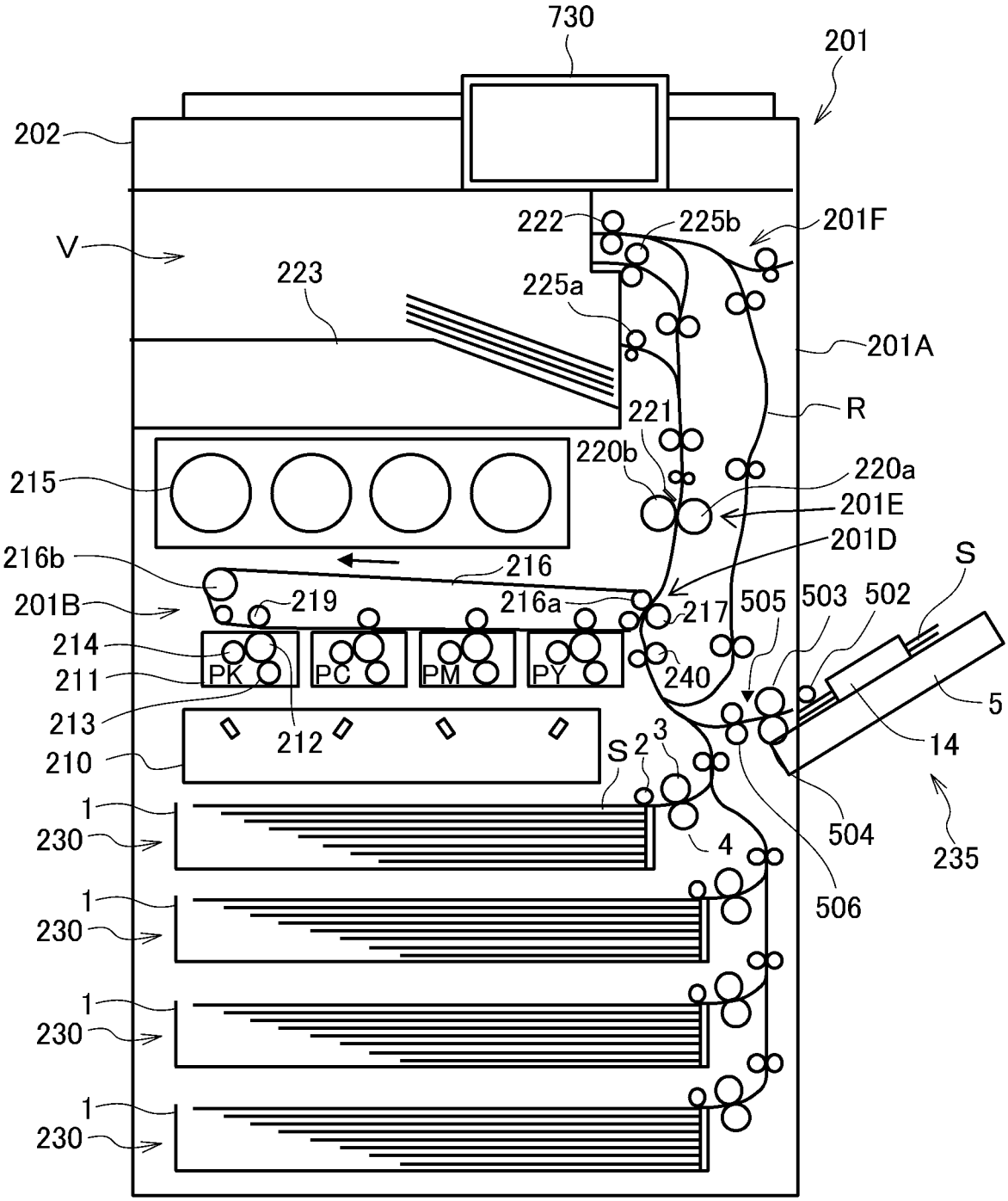
FIG. 1 is a schematic view of an image forming apparatus according to an Embodiment 1.

FIG. 1 is a cross-sectional view illustrating a schematic configuration of an image forming apparatus 201 according to an embodiment (Embodiment 1). The image forming apparatus 201 is a laser beam printer of a tandem-type and of an intermediate transfer method using an electrophotographic image forming process. The image forming apparatus 201 can form and output a full-color or a single-color image on a sheet S based on image data. As the sheet S, a variety of sheets of different sizes and materials may be used, including a plain paper and a thick paper, a plastic film, a cloth, a sheet material with a surface treatment such as a coated paper, a sheet material having a special shape such as an envelope and an index paper.

Figure 2:
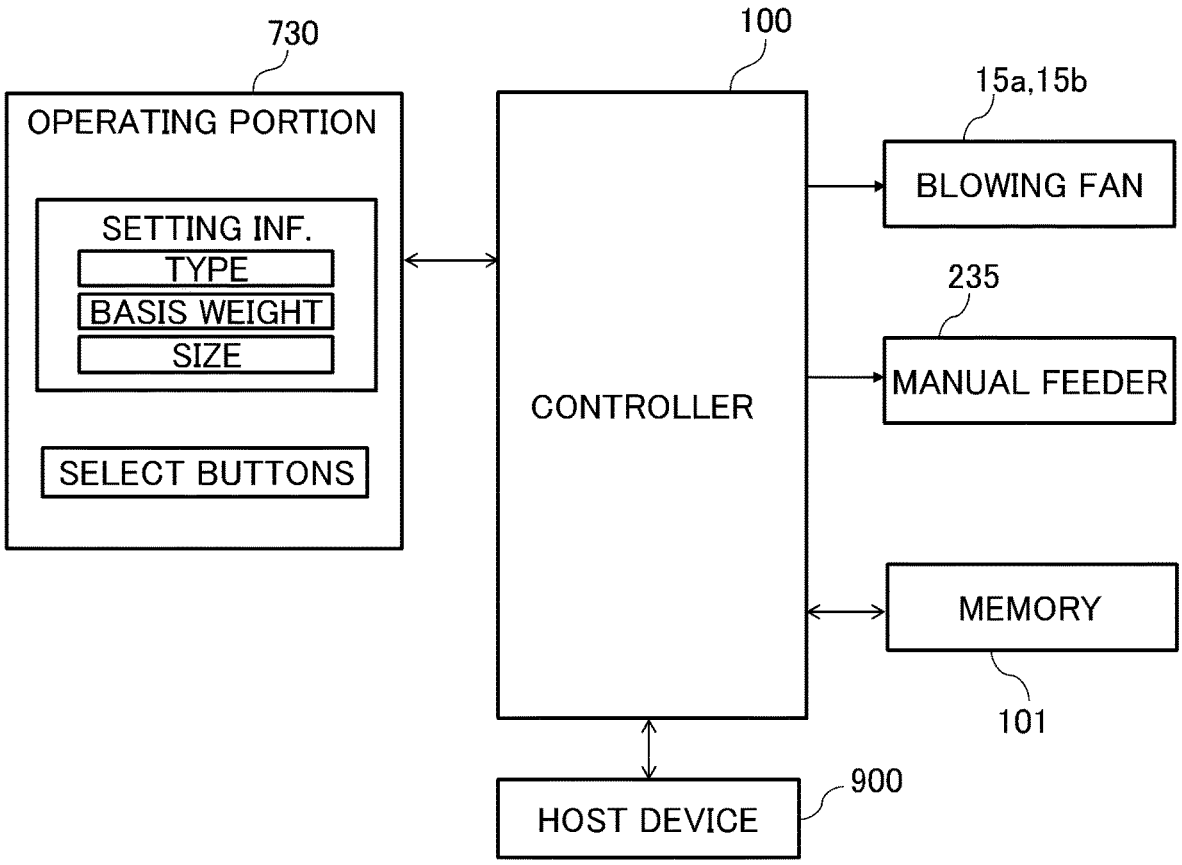
FIG. 2 is a block diagram illustrating a control system of the image forming apparatus according to the Embodiment 1.

As shown in FIG. 1, the image forming apparatus 201 is provided with a main assembly 201A accommodating an image forming portion 201B, an image reading apparatus 202 disposed above the main assembly 201A reading image information from a document, and a control portion 100 controlling an entire apparatus operation (FIG. 2). The image forming portion 201B which is an example of an image forming portion, includes four process units PY, PM, PC, and PK, an exposure device 210, a transfer belt 216, and a fixing device 201E. A discharge space V for discharging the sheets is formed between the image reading apparatus 202 and the main assembly 201A.

Each process unit PY, PM, PC and PK includes a photosensitive drum 212 as an image bearing member, a charging device 213 as a process portion acting on the photosensitive drum 212, a developing device 214, a cleaning device, etc.

The photosensitive drum 212 is an electrophotographic photosensitive member formed in a drum shape. The developing device 214 accommodates either of a yellow, a magenta, a cyan, or a black toner as a developer. The exposure device 210 as the process portion (exposure portion) is disposed below the process units PY, PM, PC, and PK.

The transfer belt 216 is an example of an intermediary transfer member. The transfer belt 216 is wound around a drive roller 216*a* and a tension roller 216*b*. Inside the transfer belt 216, four primary transfer rollers 219 are disposed at a position opposite to the corresponding photosensitive drums 212 across the transfer belt 216, respectively. The transfer belt 216 is rotated in a counterclockwise direction as shown in an arrow in the figure by a drive roller 216*a* driven by a drive portion not shown. Outside the transfer belt 216, a secondary transfer roller 217 is disposed at a position, opposite to the drive roller 216*a* across the transfer belt 216. A transfer portion 201D (secondary transfer portion) is formed as a nip portion between the secondary transfer roller 217 and the transfer belt 216.

A fixing device 201E is disposed above the transfer portion 201D. The fixing device 201E is a thermal fixing method provided with a heating roller 220*b* heated by a heating portion such as a halogen lamp, and a pressing roller 220*a* being pressurized against the heating roller 220*b*. Further above the fixing device 201E, a first discharge roller pair 225*a*, a second discharge roller pair 225*b*, and a double-sided reversing portion 201F are disposed. The double-sided reversing portion 201F includes a reversing roller pair 222 which can be rotated in a forward direction and a reverse direction and a reconveyance path R.

At an upper portion of the image forming apparatus 201, an operating portion 730 receiving operations from a user is disposed. The operating portion 730 includes a display device such as a liquid crystal panel displaying images, and an input device such as a numeric keypad and a printing execution button. For example, the user can input setting information (type, basis weight, size, brand name, etc.) of the sheet S set in a cassette feeding portion 230 and a manual feeding portion 235 via the operating portion 730.

The cassette feeding portion 230 is disposed at a lower portion of the main assembly 201A. The manual feeding portion 235 is disposed at a side surface portion of the main assembly 201A. The cassette feeding portion 230 and the manual feeding portion 235 are an example of a sheet feeding device feeding the sheet.

The cassette feeding portion 230 is provided with a cassette 1 as a sheet accommodating portion accommodating the sheet S and a pickup roller 2 as a feeding portion feeding the sheet S from the cassette 1. In addition, the cassette feeding portion 230 is provided with a separating roller pair constituted by a feed roller 3 and a retard roller 4 as a separation conveyance portion for separating the sheet S fed from the pickup roller 2. The retard roller 4 applies a frictional force to the sheet S in a nip portion between the retard roller 4 and the feed roller 3 in an opposite direction to a feeding direction, thereby permitting only a single sheet S in contact with the feed roller 3 to pass through the nip portion.

FIG. 2 is a block diagram illustrating a system configuration of the image forming apparatus 201. A control portion 100 is a control portion controlling operations of the image forming apparatus 201 comprehensively and transfers information to and from a host device 900 and the operating portion 730. In addition, the control portion 100 controls operations of the image forming portion 201B, and of a feeding and a conveyance of the sheets, etc. Here, the host device 900 is a personal computer, an image scanner, a facsimile, etc. A storage portion 101 stores programs executed by the control portion 100 and data necessary to execute the programs. In addition, the storage portion 101 provides a workspace when the control portion 100 executes the program.

The control portion 100 controls operations of the image forming apparatus 201 based on the setting information entered by the user via the operating portion 730 and the image data received from the host device 900. For example, the control portion 100 controls a sheet feeding operation by driving an actuator (motor, etc.) of the manual feeding portion 235. In addition, the control portion 100 actuates blowing fans 15*a* and described below when the control portion 100 determines that a separation by blowing air is necessary based on the setting information of the sheet (e.g., in cases of the coated paper).

(Image Forming Operation)

The control portion of the image forming apparatus 201 starts an image forming operation when the control portion receives the image data from the external device or receives the image data read from a document by the image reading apparatus 202 as an execution instruction of a copying operation is given. In the image forming operation, each of the process units PY, PM, PC, and PK forms a toner image on a surface of the photosensitive drum 212 by an electrophotographic process. That is, when a formation of the toner image is requested to the process units PY, PM, PC, and PK, the photosensitive drum 212 is driven and rotated, and the charging device 213 uniformly charges the surface of the photosensitive drum 212. The exposure device 210 irradiates a laser beam onto the photosensitive drum 212 based on the image data received from the outside by the control portion or the image data read from the document by the image reading apparatus 202. As a result, the surface of photosensitive drum 212 is exposed and an electrostatic latent image is formed. The developing device 214 supplies the developer containing the toner to the photosensitive drum 212 and develops the electrostatic latent image into the toner image.

The toner images formed by the process units PY, PM, PC, and PK are primarily transferred to the transfer belt 216 by the primary transfer roller 219. When forming a full-color image, the primary transfer is performed so that the toner images of each color overlap on the transfer belt 216, and thereby forming a color image on the transfer belt 216. Adhesive materials such as the toner remaining on the photosensitive drum 151 is removed by the cleaning device of each of the process units PY, PM, PC, and PK.

In parallel with the operation of the image forming portion 201B, the sheets S are fed one by one from the cassette feeding portion 230 or the manual feeding portion 235 and conveyed to a registration roller pair 240. After correcting an oblique movement of the sheet S, the registration roller pair 240 conveys the sheet S to the transfer portion 201D at a timing synchronized with the operation of the image forming portion 201B. And in the transfer portion 201D, the toner image is secondarily transferred from the transfer belt 216 to the sheet S by the secondary transfer roller 217 to which transfer voltage is applied.

The sheet S that has passed through the transfer portion 201D is conveyed to the fixing device 201E. The fixing device 201E heats and pressurizes the toner image on the sheet S while nipping and conveying the sheet S between the heating roller 220*b* and the pressing roller 220*a*. By this, a fixed image is produced on the sheet S. Incidentally, a sticking force to the heating roller 220*b* is generated on the sheet S due to an adhesive force of the melted toner. If a stiffness of the sheet S is low (weak), the sheet S may be wound around the rotating heating roller 220*b*, therefore a separating plate 221 is disposed at a downstream side of the heating roller 220*b* to separate the sheet.

In a case of a single-side printing, the sheet S that has passed through the fixing device 201E is discharged into the discharge space V by the first discharge roller pair 225*a* or the second discharge roller pair 225*b*, and is stacked on a discharge tray 223. In a case of a double-side printing, the sheet S of which the image is formed on a first side by passing through the transfer portion 201D and the fixing device 201E is reversed by the reversing roller pair 222 and conveyed again to the image forming portion 201B via the reconveyance path R. And the sheet S on which an image is formed on a second side by passing through the transfer portion 201D and the fixing device 201E again is discharged into the discharge space V by the first discharge roller pair 225*a* or the second discharge roller pair 225*b*, and is stacked on the discharge tray 223.

In the above description, the image forming portion 201B is an example of an image forming portion and instead of the image forming portion 201B, an electrophotographic unit of a direct transfer method or an image forming unit of an inkjet method or of an offset printing method may be used.

(Manual Feeding Portion)

Figure 3:
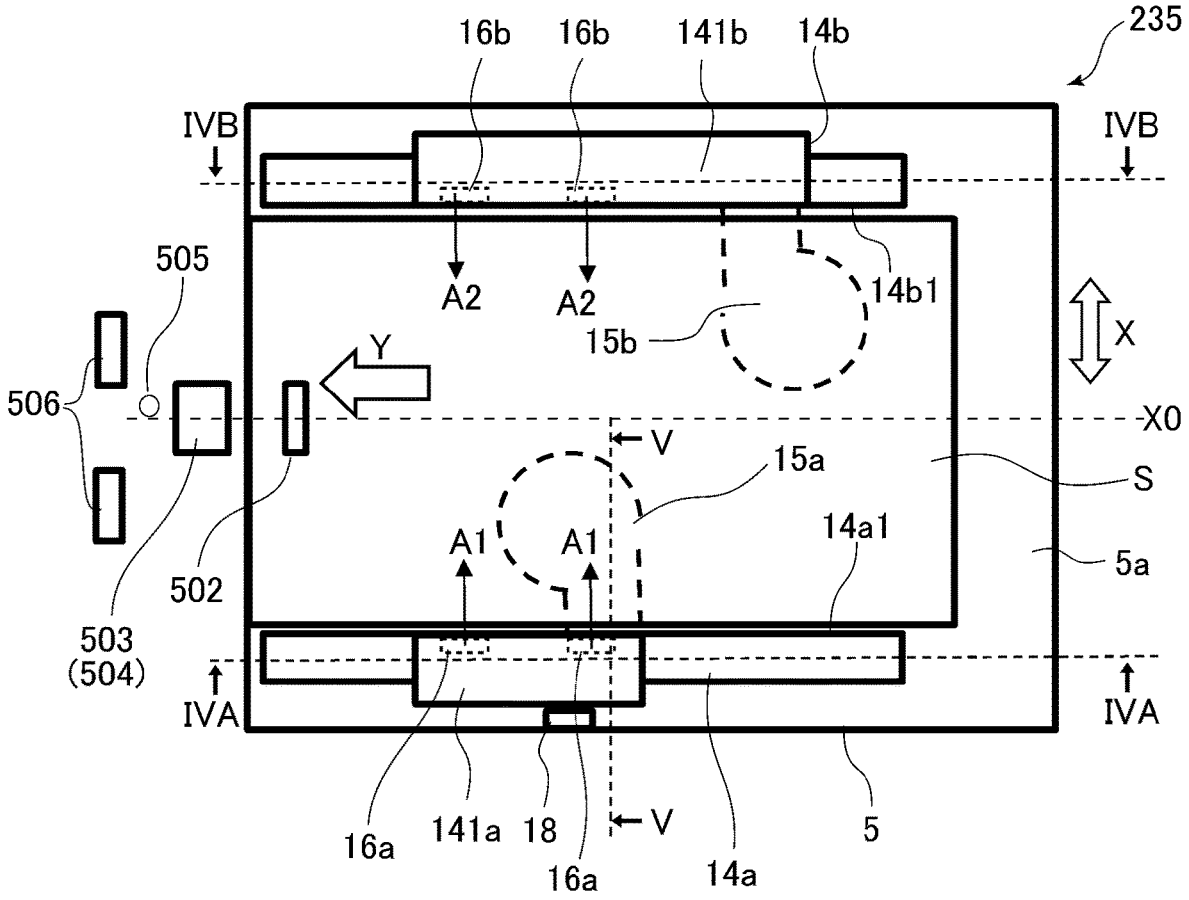
FIG. 3 is a schematic view of a manual feeding portion according to the Embodiment 1 as viewed from above.

The manual feeding portion 235 provided with an air blowing portion will be described using FIG. 3. FIG. 3 is a schematic view of the manual feeding portion 235 as viewed from above. Unlike the cassette feeding portion 230 which can accommodate a large number of the sheets, the manual feeding portion 235 is configured so that the user sets a necessary amount of the sheets when using the image forming apparatus 201. Therefore, the cassette feeding cassette 230 is suitable for using sheets of a plain paper with a standard size which are frequently used, while the manual feeding portion 235 is suitable for using sheets such as the coated paper and a long sheet which are less frequently used.

In the description below, a "feeding direction Y" represents a direction in which sheets are fed from a feed tray 5 by a pickup roller 502. A "sheet widthwise direction X" represents a direction which is along the sheet stacked on the feed tray 5 and is perpendicular to the feeding direction Y.

The manual feeding portion 235 is provided with the feed tray 5, the pickup roller 502, a feed roller 503, a retard roller 504, a side end guide 14*a* and a side end guide 14*b*, and a blowing fan 15*a* and a blowing fan 15*b*.

Figure 18:
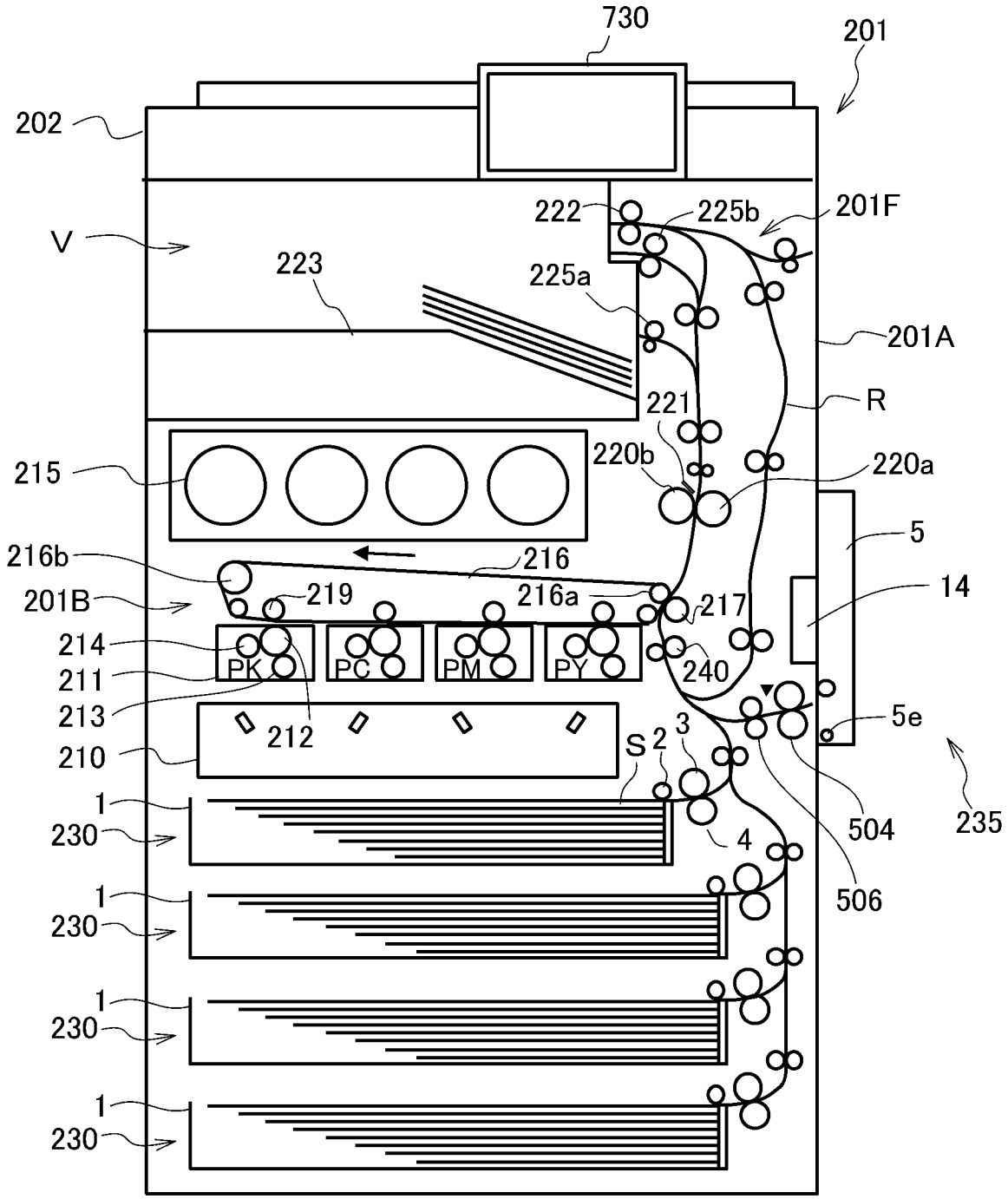
FIG. 18 is a schematic view of the image forming apparatus according to the Embodiment 1.

The feed tray 5 is a tray (stacking member) on which sheets are stacked. The feed tray 5 includes a stacking surface 5*a* (a support surface supporting a lower surface of a sheet, a mounting surface) on which a sheet is stacked. The feed tray 5 can be rotated (openable and closable), with a support portion 5*e* (hinge portion) as a rotational center, between an accommodated position (see FIG. 18) in which the feed tray 5 is accommodated in the side surface portion of the main assembly 201A of the image forming apparatus 201 and a feeding position in which the feed tray 5 is protruding outside the main assembly 201A and capable of feeding the sheets. In a state where the feed tray 5 is opened, the user can set the sheets onto the feed tray 5. The feed tray 5 is also called as a manual feed tray or a multi-purpose tray.

The pickup roller 502 is an example of a feeding portion feeding the sheets. The pickup roller 502 is disposed above the stacking surface 5*a* of the feed tray 5. The pickup roller 502 is rotatably supported by a roller holder as a holding member. The roller holder is swingable about a rotation axis of the feed roller 503. As the roller holder swings, the pickup roller 502 moves between a feeding position (contact position, lower position) where the pickup roller 502 contacts an upper surface of the sheet stacked on the feed tray 5, and a standby position (separation position, upper position) where the pickup roller 502 is separated above from the sheet. The sheet is fed from the feed tray 5 in the feeding direction Y as the pickup roller 502 rotates in the feeding position. Instead of the pickup roller 502, a mechanism conveying the sheet, for example, by adsorbing the sheet to a belt by a negative pressure generated by a fan and rotating the belt may be used.

The feed roller 503 further conveys the sheet received from the pickup roller 502 in the feeding direction Y. A conveyance roller pair 506 is disposed downstream of the feed roller 503 that conveys the sheet received from the feed roller 503 toward the registration roller pair 240 (FIG. 1).

The retard roller 504 is pressurized against the feed roller 503 and forms a separation nip between the feed roller 503 and the retard roller 504. In addition, a driving force in a direction that goes against a rotation of the feed roller 503 is inputted to the retard roller 504 via a torque limiter. The retard roller 504 is an example of a separating member separating the sheet with a frictional force and instead of the retard roller 504, for example, a roller member connected to a fixed shaft via the torque limiter or a pad-shaped elastic member abutting the feed roller 503 may be used.

The side end guides 14*a* and 14*b* are regulating members (regulating plates) regulating a position of the sheet with respect to the sheet widthwise direction X. In the present Embodiment, a pair of the side end guides 14*a* and 14*b* facing each other with respect to the sheet widthwise direction X is used. The side end guide 14*b* of a rear side is a second side end guide disposed opposite to the side end guide 14*a* as a first side end guide with respect to the sheet widthwise direction X. The side end guides 14*a* and 14*b* are provided with regulating surfaces 14*a*1 and 14*b*1 as inside surfaces with respect to the sheet widthwise direction X, respectively. An "inside" of the sheet widthwise direction X with respect to one of the side end guides is a side where the other of the side end guides is disposed and is a side where the sheet is stacked, and an "outside" of the sheet widthwise direction X is an opposite side to the side where the other of the side end guides is disposed. The regulating surfaces 14*a*1 and 14*b*1 are surfaces extending in the feeding direction Y and rising substantially perpendicular to the feed tray 5 as viewed in the feeding direction Y. The regulating surfaces 14*a*1 and 14*b*1 regulate the position of the sheet with respect to the sheet widthwise direction X by abutting end portions in the sheet widthwise direction X of the sheet (side ends of the sheet) stacked on the feed tray 5.

The side end guides 14*a* and 14*b* are movable in the sheet widthwise direction X relative to the feed tray 5. The side end guides 14*a* and 14*b* are connected by an interrelating mechanism such as a rack and pinion mechanism and move in interrelation with each other so that a distance from a center position XO to each of the side end guides in the sheet widthwise direction X is the same. The center position XO is a reference position in the sheet widthwise direction X of the sheets that the manual feeding portion 235 feeds.

One of the side end guides 14*a* and 14*b* (the side end guide 14*a* on a front side of the image forming apparatus 201) is provided with an operating knob 18 as an operating portion (gripping portion) for moving the side end guides 14*a* and 14*b*. The user can prevent the oblique movement and a misalignment of the sheet by moving the side end guides 14*a* and 14*b* to a position that matches the size of the sheet to be used.

The blowing fans 15*a* and 15*b* are examples of blowing fans (blowing portions, blowers) that blow the air to promote a separation of the sheet stacked on the feed tray 5. The blowing fans 15*a* and 15*b*, for example, suck outside air via a sucking inlet provided in a bottom surface of the feed tray 5 to generate an air flow. The blowing fans 15*a* and of the present Embodiment are disposed on a lower side of the stacking surface 5*a* of the feed tray 5. The blowing fans 15*a* and 15*b* are fan motors integrating a main body of the fan which generates the air flow by a rotation and a motor which drives the main body of the fan.

The side end guides 14*a* and 14*b* are provided with blowing outlets 16*a* and 16*b* for blowing the air from the blowing fans 15*a* and 15*b* to the side ends of the sheet on the feed tray 5, respectively. The blowing outlets 16*a* and 16*b* are openings formed in the regulating surfaces 14*a*1 and 14*b*1 of the side end guides 14*a* and 14*b*, respectively. In addition, the blowing outlets 16*a* and 16*b* are connected to exhaust portions of the blowing fans 15*a* and 15*b* through ducts (air paths) formed inside the side end guides 14*a* and 14*b*, respectively.

When blowing fans 15*a* and 15*b* are actuated, the air is blown from the blowing outlets 16*a* and 16*b* toward the inside with respect to the sheet widthwise direction X, as shown in stream lines A1 and A2, respectively.

Incidentally, heights of the openings of the blowing outlets 16*a* and 16*b* are set higher than the maximum stacking height of the sheets in the feed tray 5, respectively. The maximum stacking height of the sheets is indicated, for example, by attaching a sticker indicating the maximum stacking height to at least one of the regulating surfaces 14*a*1 and 14*b*1 of the side end guides 14*a* and 14*b*.

In addition, in a case where it is varied whether an air blowing is performed or not depending on the type of the sheets, the maximum stacking height of the sheets (e.g., coated papers) to which the air blowing is performed may be set lower than the maximum stacking height of the sheets (e.g., plain papers) to which the air blowing is not performed. In addition, when the coated paper is selected at the operating portion 730 by the user, a message to caution the user about the maximum stacking height may be displayed.

(Feeding Operation of Manual Feeding Portion)

Next, the feeding operation in which the manual feeding portion 235 feeds the sheets will be described with reference to FIG. 2. The user sets the sheets on the feed tray 5 in advance and enters the setting information on the set sheets via the operating portion 730.

When the user presses the printing execution button, the blowing fans 15*a* and 15*b* are actuated to start blowing the air, and the air is blown from the blowing outlets 16*a* and 16*b* to the side ends of the sheets. By this air entering into spaces between the sheets, the sheet comes to float and thereby reduces the adhesive force between the sheets. As a result, the manual feeding portion 235 can separate and feed the sheets one by one stably, even when using the sheets such as the coated papers, which have a high smoothness of a surface and between which a sticking is likely to occur. Incidentally, the control portion 100 of the image forming apparatus 201 may be configured to actuate the blowing fans 15*a* and 15*b* only when it is determined that a separation by the air blowing is necessary based on the sheet setting information (e.g., in the case of the coated papers).

After a predetermined time elapses from a start of blowing air by the blowing fans 15*a* and 15*b*, rotations of the pickup roller 502 and the feed roller 503, etc. are initiated, and the pickup roller 502 is moved from the standby position to the feeding position as the roller holder is swinged. Then, the topmost sheet that abuts the pickup roller 502 is fed to the feed roller 503, separated from the other sheets in the separating nip to be conveyed further, and conveyed to the registration roller pair 240 (FIG. 1) by the conveyance roller pair 506. The flows of the sheet conveyance and the image formation after this process are as described above. Incidentally, a timing of the conveyance of the sheet is monitored by a sheet sensor 505 (FIG. 1) detecting the sheet at a position between the feed roller 503 and conveyance roller pair 506.

(Details of Air Blowing Configuration)

Details of a configuration for blowing the air to the sheet in the present Embodiment will be described using FIG. 3 through FIG. 10 below.

Figure 4:
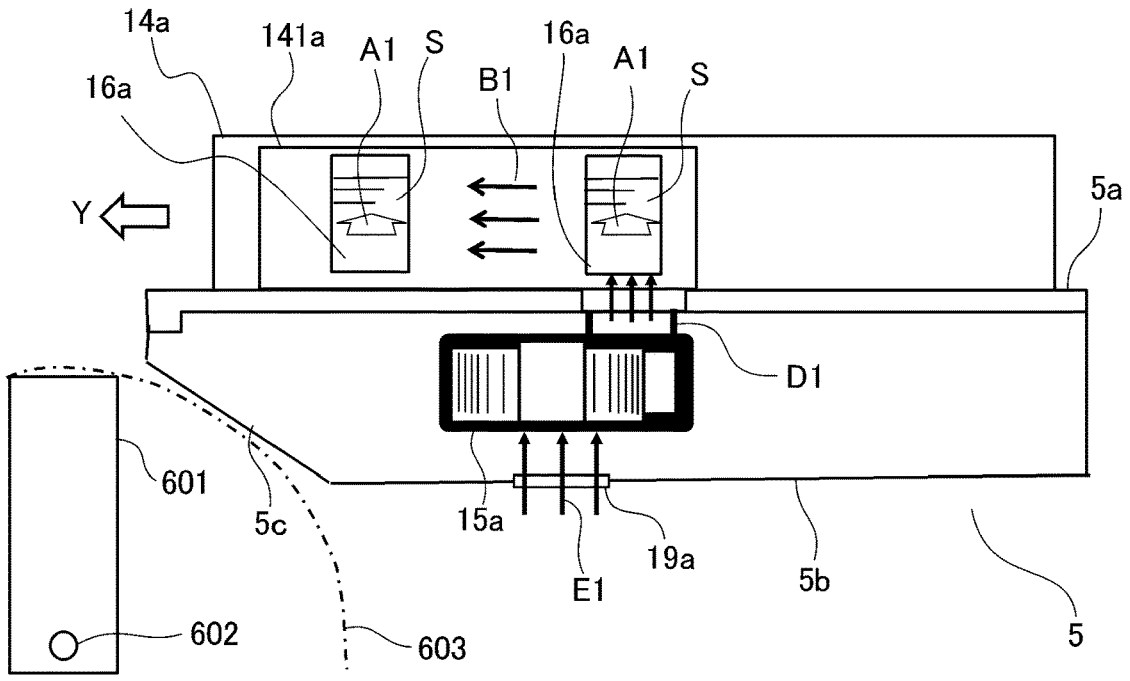
FIG. 4, part (a) and (b), is a schematic view illustrating cross sections of the manual feeding portion according to the Embodiment 1.
Figure 4:
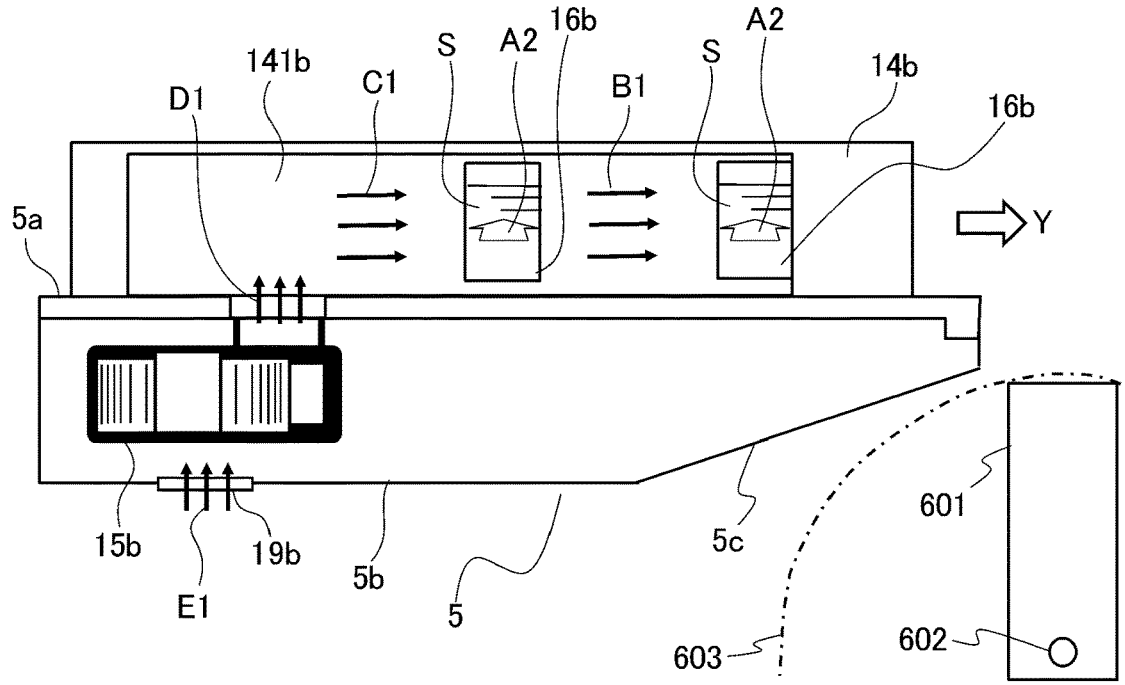
Figure 5:
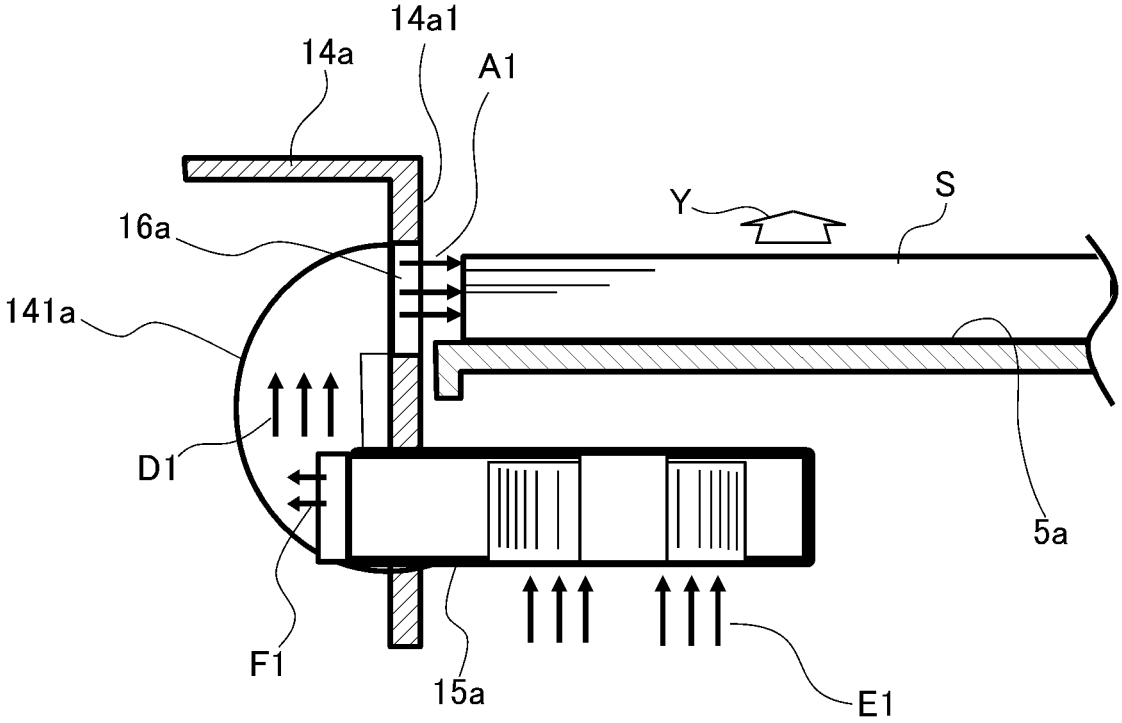
FIG. 5 is a schematic view illustrating a cross section of the manual feeding portion according to the Embodiment 1.
Figure 6:
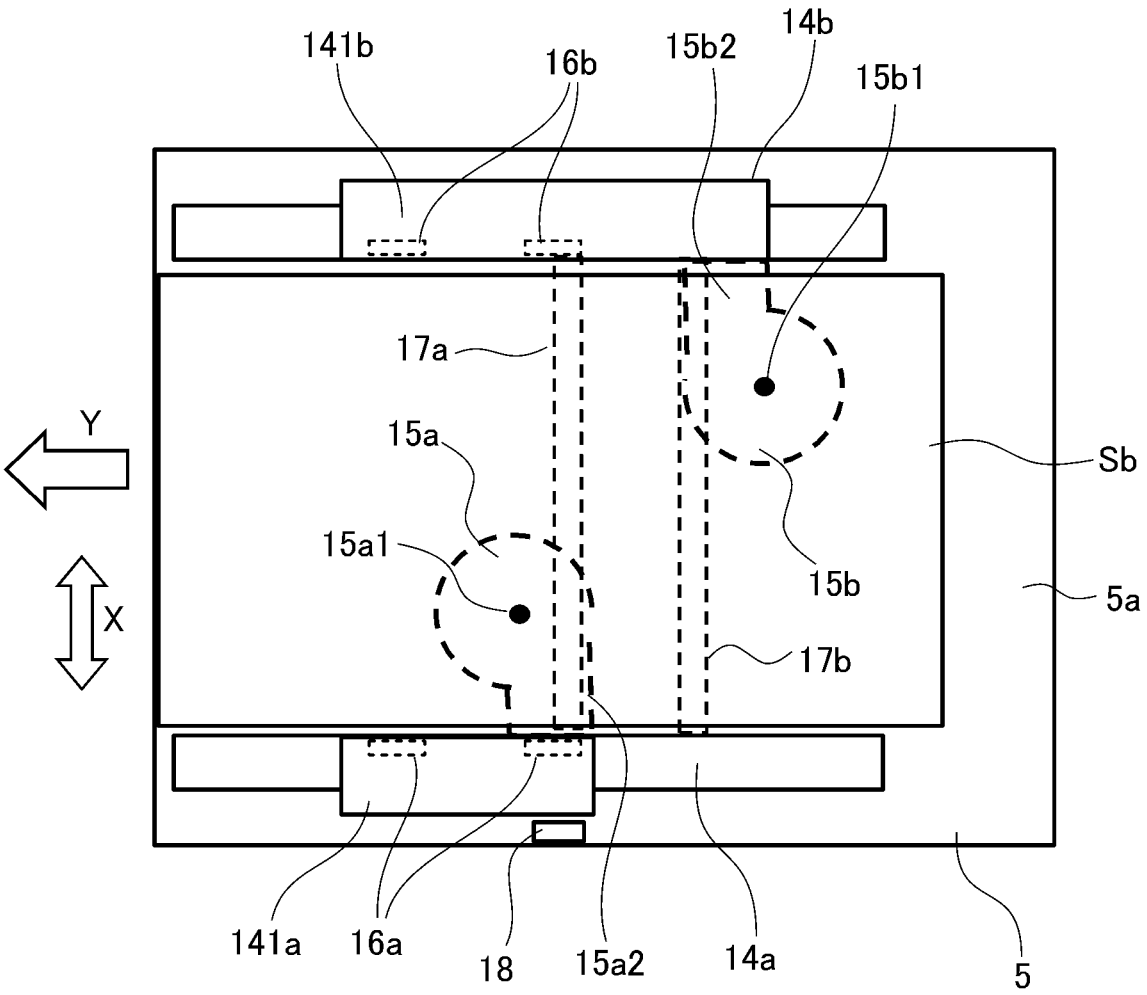
FIG. 6 is a schematic view of the manual feeding portion according to the Embodiment 1 as viewed from above.
Figure 7:
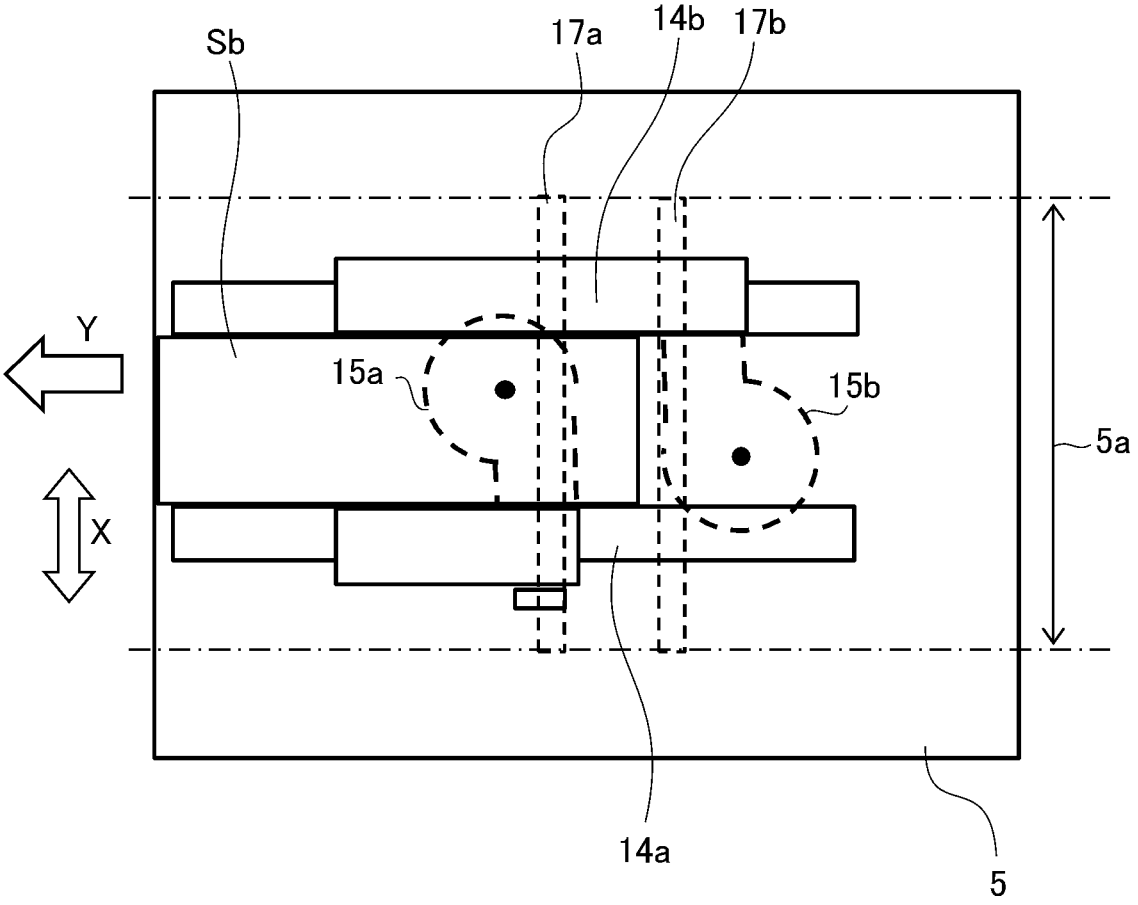
FIG. 7 is a schematic view of the manual feeding portion according to the Embodiment 1 as viewed from above.
Figure 8:
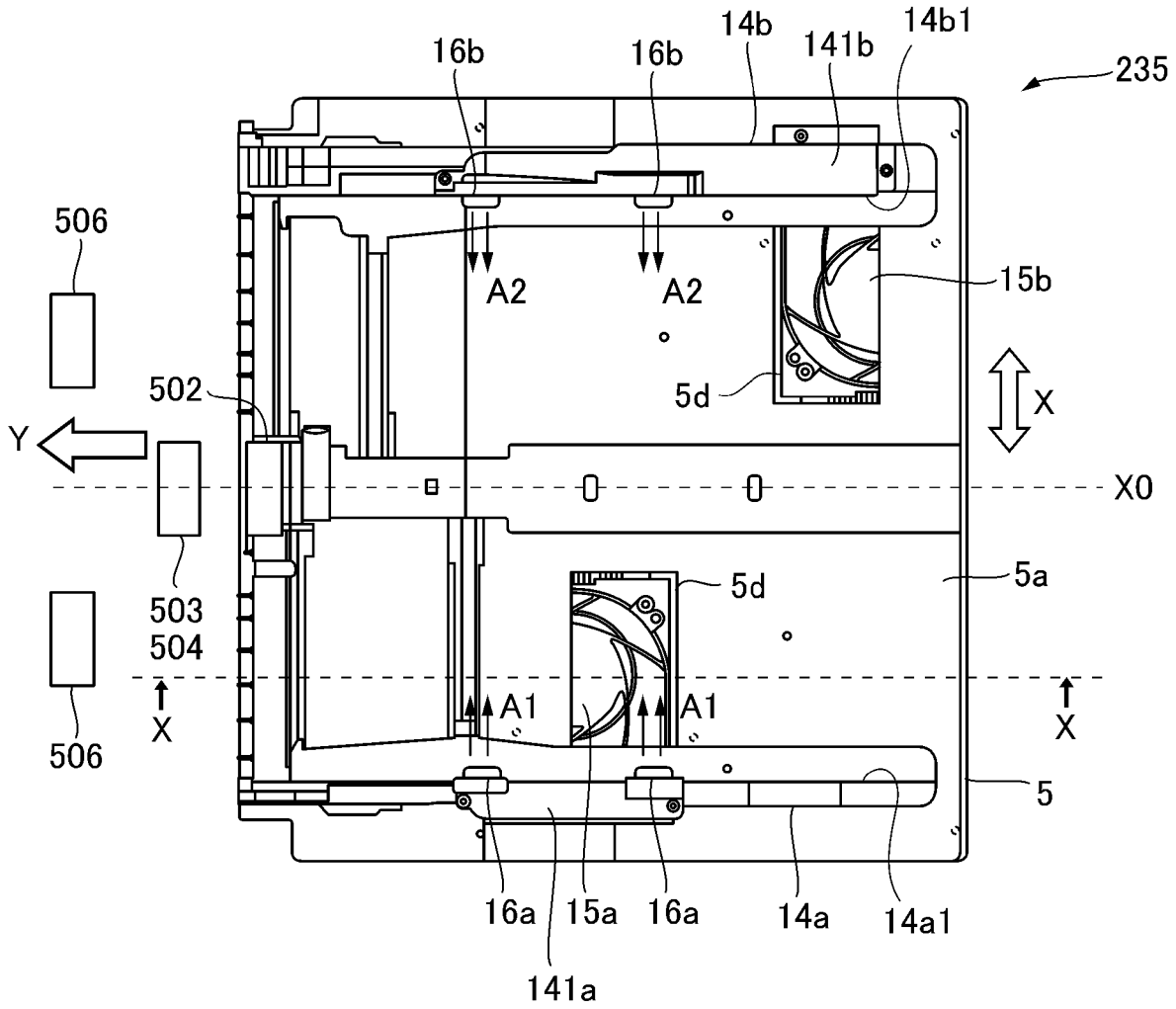
FIG. 8 is a detail view of the manual feeding portion according to the Embodiment 1 as viewed from above.
Figure 9:
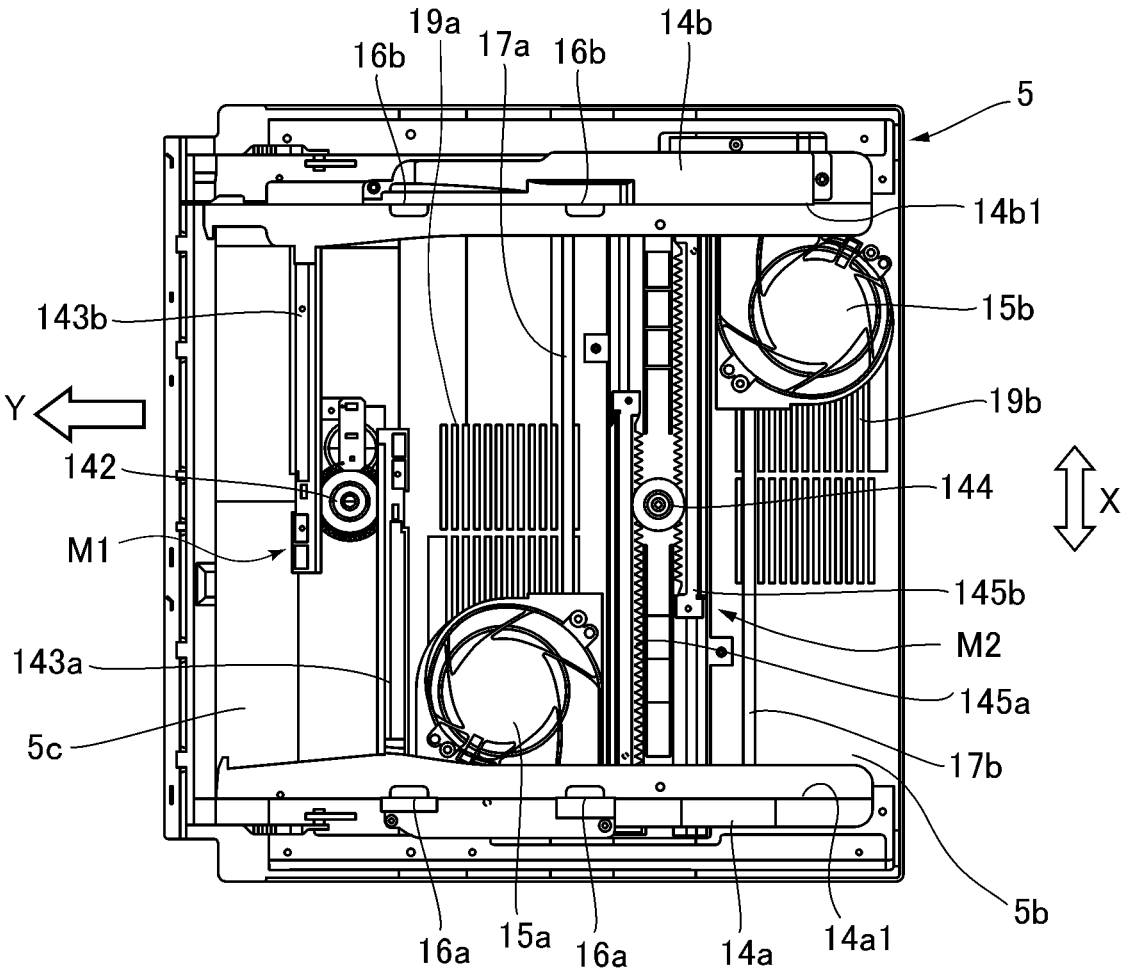
FIG. 9 is a detail view illustrating an inside of a feed tray according to the Embodiment 1.
Figure 10:
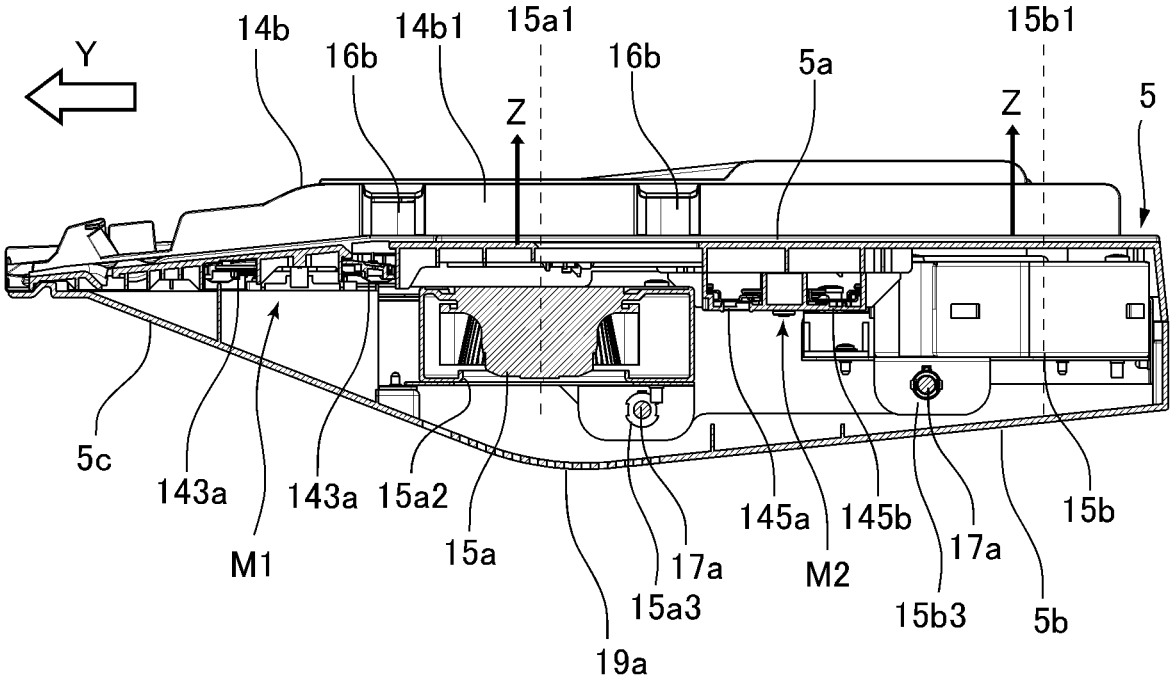
FIG. 10 is a detail view illustrating a cross section of the manual feeding portion according to the Embodiment 1.

FIG. 3 is a schematic view of the manual feeding portion 235 as viewed from above. FIG. 4(*a*) is a cross-sectional view illustrating a cross section IVA-IVA of FIG. 3. FIG. 4(*b*) is a cross-sectional view illustrating a cross section IVB-IVB of FIG. 3. FIG. 5 is a cross-sectional view illustrating a cross section V-V of FIG. 3. FIG. 6 is a schematic view illustrating a state in which the side end guides 14*a* and 14*b* are moved to the outermost position (a side end position of a sheet Sa of the largest size that can be fed from the manual feeding portion 235). FIG. 7 is a schematic view illustrating a state in which the side end guides 14*a* and 14*b* are moved to the innermost position (a side end position of a sheet Sb of the smallest size that can be fed from the manual feeding portion 235). FIG. 8 is a detail view of the manual feeding portion 235 as viewed from above. FIG. 9 is a view seeing through an upper surface of the feed tray 5 in FIG. 8. FIG. 10 is a cross-sectional view illustrating a cross section X-X of FIG. 8.

As shown in FIG. 4(*a*), FIG. 4(*b*) and FIG. 5, the blowing fans 15*a* and are disposed below the stacking surface 5*a* of the feed tray 5. In other words, the blowing fans 15*a* and 15*b* are disposed on an opposite side to a side where the sheet is stacked on the stacking surface 5*a*. By this configuration, it becomes possible to save space in the manual feeding portion 235 provided with the air blowing configuration. In other words, when the blowing fan 15*a* is disposed on an upper side of the stacking surface 5*a*, the blowing fan has to be disposed while avoiding the stacking surface 5*a*. In this case, the air blowing fan is protruding to an outside of the feed tray 5 with respect to the sheet widthwise direction X, etc., which increases a space occupied by the manual feeding portion 235, and this in turn leads to a larger size of the image forming apparatus.

In contrast, in the present Embodiment, since the air blowing fans 15*a* and 15*b* are disposed in a space on the lower side of the stacking surface 5*a* of the feed tray 5, which can save space of the manual feeding portion 235, and it becomes possible for the image forming apparatus to be downsized. In addition, since the blowing fans 15*a* and are not protruded in the upper side of the feed tray 5, accessibility to the feed tray 5 is improved and thereby improving usability, and it is also advantageous in terms of noise reduction.

It is preferable for the blowing fans 15*a* and 15*b* to be disposed so that at least a part of the blowing fans 15*a* and 15*b* is overlapped with the stacking surface 5*a* of the feed tray 5 as viewed from above (FIG. 3). With respect to the sheet widthwise direction X, each of the blowing fans 15*a* and 15*b* is disposed at a position overlapped with the stacking surface 5*a*, respectively. In other words, the blowing fan 15*a* is disposed so that a position of at least a part of the blowing fan 15*a* with respect to the sheet widthwise direction X is overlapped with a position of the stacking surface 5*a* with respect to the sheet widthwise direction X. Similarly, the blowing fan 15*b* is disposed so that a position of at least a part of the blowing fan 15*b* with respect to the sheet widthwise direction X is overlapped with the position of the stacking surface 5*a* with respect to the sheet widthwise direction X. By this it becomes possible for the image forming apparatus to be downsized further. The stacking surface 5*a* (sheet stacking region) of the feed tray 5 is defined as a region where the sheet Sa of the largest size among the sheets that can be fed from the manual feeding portion 235 is stacked on the upper surface of the feed tray 5. In other words, the stacking surface 5*a* of the feed tray 5 is the sheet stacking region where the sheet Sa is stacked in a state in which the side end guides 14*a* and 14*b* are widened to the outermost with respect to the sheet widthwise direction X (FIG. 6). Therefore, a region where the sheet Sb is stacked in a state in which the side end guides 14*a* and 14*b* are narrowed to the innermost with respect to the sheet widthwise direction X (FIG. 7) is a part of the stacking surface 5*a* in the present Embodiment, and is completely included by the stacking surface 5*a*. In other words, even in a state of FIG. 7, the stacking surface 5*a* of the feed tray 5 is still in a region within a width of the sheet Sa of the largest size indicated by a single-dotted line in FIG. 7.

Incidentally, as shown in FIG. 6, a part of the blowing fan 15*a* with respect to the sheet widthwise direction X may overlap a position of the stacking surface 5*a* with respect to the sheet widthwise direction X, or an entire blowing fan 15*a* with respect to the sheet widthwise direction X may overlap a position of the stacking surface 5*a* with respect to the sheet widthwise direction X.

It is preferable for the blowing fans 15*a* and 15*b* to be accommodated inside a housing of the feed tray 5. That is, it is preferable for the blowing fans 15*a* and 15*b* to be accommodated in an inner space of the feed tray 5 expanding between the stacking surface 5*a* (upper surface) and a bottom surface 5*b* of the feed tray 5 as shown in Figure According to this configuration, since the blowing fans 15*a* and 15*b* are not exposed to the outside, it has the advantages such as improved safety, aesthetics in appearance, noise reduction. In addition, the feed tray 5 is openable and closable with respect to the main assembly 201A without concerning about interference between the blowing fans 15*a* and 15*b* and the main assembly 201A. Therefore, compared to a case where a space to receive the blowing fans 15*a* and 15*b* is secured for when the feed tray 5 is closed to the main assembly 201A, for example, it has the advantages such as downsizing of the apparatus and improving design freedom.

As shown in FIG. 3, FIG. 6 and FIG. 7, the blowing fan 15*a* is attached to the side end guide 14*a*, which is movable in the sheet widthwise direction X with respect to the feed tray 5, and moves integrally with the side end guide 14*a*. Similarly, the blowing fan 15*b* is attached to the side end guide 14*b*, which is movable in the sheet widthwise direction X with respect to the feed tray 5, and moves integrally with the side end guide 14*b*. By configuring the blowing fans 15*a* and 15*b* to move integrally with the side end guides 14*a* and 14*b*, a configuration of the ducts (air paths) that lead air from the blowing fans 15*a* and 15*b* to the blowing outlets 16*a* and 16*b* can be simplified.

In a wall surface of the feed tray 5 opposite to openings of a suction side of the blowing fans 15*a* and 15*b*, a sucking inlet is provided (FIG. 9). In the present Embodiment, the bottom surface 5*b* of the feed tray 5 is provided with sucking inlets 19*a* and 19*b* lined with a plurality of slits extending in the sheet widthwise direction X. The sucking inlets 19*a* and 19*b* may have lengths so that a state that at least a part of an opening 15*a*2 of a suction side of the blowing fan (FIG. 10) is opposite to the sucking inlets 19*a* and 19*b* is maintained in a case in which the side end guides 14*a* and 14*b* move from one end of a moving range to the other end. By this, it becomes possible to prevent a pressure drop from increasing as the blowing fans 15*a* and 15*b* go farther away from the sucking inlets 19*a* and 19*b*. The lengths of the sucking inlets 19*a* and 19*b* in the sheet widthwise direction X may be longer than a diameter of the opening 15*a*2 (FIG. 10) on the suction side of the blowing fans 15*a* and 15*b*.

As shown in FIG. 4(*a*), the blowing fan 15*a* on the front side sucks air (outside air) from the outside of the feed tray 5 via the sucking inlet 19*a* (stream line E1). A duct 141*a* is formed inside the side end guide 14*a*. The air exhausted from the blowing fan (stream line D1) is led to the blowing outlets 16*a* by the duct 141*a*. In the present Embodiment, the duct 141*a* extends in the feeding direction Y inside the side end guide 14*a* so that the air is distributed to two blowing outlets 16*a* (first blowing outlet and second blowing outlet) by the duct 141*a* (stream line B1). And the air is blown from the blowing outlets 16*a* to the side end of the sheet S toward the inside of the sheet widthwise direction X (stream line A1, see also FIG. 3).

As shown in FIG. 4(*b*), the air path on the rear side is the same as that on the front side except that a position of the blowing fan 15*b* is different. That is, the blowing fan 15*b* sucks air (outside air) from the outside of the feed tray 5 via the sucking inlet 19*b* (stream line E1). A duct 141*b* is formed inside the side end guide 14*b*. The air exhausted from the blowing fan 15*b* (stream line D1) is led to the blowing outlets 16*b* by the duct 141*b*. In the present Embodiment, the duct 141*b* extends in the feeding direction Y inside the side end guide 14*b* so that air is distributed to two blowing outlets 16*b* by the duct 141*b* (stream line B1 and C1). And the air is blown from the blowing outlets 16*b* to the side end of the sheet S toward the inside of the sheet widthwise direction X (stream line A2 in FIG. 3).

As shown in FIG. 5, as viewed in the feeding direction Y, an exhausting direction of the blowing fan 15*a* and a blowing direction of the air from the blowing outlets 16*a* are disposed in opposite directions with respect to the sheet widthwise direction X. That is, the blower fan 15*a* is disposed to exhaust air outside with respect to the sheet widthwise direction X (stream line F1). The blowing outlets 16*a* are disposed to blow the air inside with respect to the sheet widthwise direction X (stream line A1). Thus, in the configuration where the blowing fan 15*a* is provided integrally with the side end guide 14*a*, the blowing fan 15*a* is disposed by utilizing the space inside the sheet widthwise direction X with respect to the side end guide 14*a*. By this configuration, it becomes possible to save space of the manual feeding portion 235 with respect to the sheet widthwise direction X. In addition, it is preferable for an entire rotary blade, which is a main body portion of the blowing fan 15*a*, to be positioned inside the regulating surface 14*a*1 with respect to the sheet widthwise direction X.

While FIG. 5 illustrates an arrangement of the blowing fan 15*a* on the front side, the same is true for the blowing fan 15*b* on the rear side except that a positioning is reversed with respect to the sheet widthwise direction X. That is, as viewed in the feeding direction Y, an exhausting direction of the blowing fan 15*b* and a blowing direction of the air from the blowing outlets 16*b* are disposed in opposite directions with respect to the sheet widthwise direction X (see FIG. 3). By this configuration, it becomes possible to save the space of the manual feeding portion 235 with respect to the sheet widthwise direction X.

As shown in FIG. 9 and FIG. 10, in the present Embodiment, a sirocco fan, which is a type of a centrifugal fan, is used as the blowing fans 15*a* and 15*b*, and rotation axes 15*a*1 and 15*b*1 of the rotary blades are disposed so as to be crossed with the stacking surface 5*a* of the feed tray 5. It is preferable that the rotation axes 15*a*1 and 15*b*1 are disposed so as to be substantially perpendicular to the stacking surface 5*a* (substantially parallel to a normal direction Z of the stacking surface 5*a*). By this, it become possible to downsize the feed tray 5 with respect to a thickness direction.

Incidentally, a centrifugal fan is a fan that sucks air from one side of the rotary blades in an axial direction and exhausts in a direction perpendicular to the axial direction (centrifugal direction), and is, for example, the sirocco fan or a turbo fan. Among centrifugal fans, the sirocco fan is superior in terms of satisfying quietness, durability, and static pressure required for a sheet separation, etc., in a well-balanced manner. A centrifugal fan other than the sirocco fan or an axial fan can also be used, however, as the blowing fan.

By the way, as shown in FIG. 5, the duct 141*a* penetrates the upper side of the feed tray 5 from the lower side to the upper side so as to connect the blowing fan 15*a*, which is disposed below the stacking surface 5*a* of the feed tray 5, with the blowing outlets 16*a*, which is disposed above the stacking surface 5*a*. The same is true for the duct 141*b* on the rear side. Therefore, as shown in FIG. 8, notches 5*d* (slits, opening portions) that permit movements of the ducts 141*a* and 141*b* in the sheet widthwise direction X along movements of the side end guides 14*a* and 14*b* are formed in the stacking surface 5*a*. A position and a shape of the notches 5*d* may be varied to match the ducts 141*a* and 141*b*. Besides this, notches through which a portion of the side end guides 14*a* and 14*b* penetrate vertically is also formed near an interrelating mechanism M1 (described below) in the stacking surface 5*a*.

A configuration with respect to the movement of the side end guides 14*a* and 14*b* and the blowing fans 15*a* and 15*b*, and a positioning of the blowing fans 15*a* and 15*b* will be described below. As shown in FIG. 6 and FIG. 7, the pair of the side end guides 14*a* and 14*b* move in interrelation with each other in the sheet widthwise direction X.

As shown in FIG. 9, the side end guides 14*a* and 14*b* are connected to each other by the interrelating mechanisms M1 and M2 inside the feed tray 5. In the present Embodiment, a rack and pinion mechanism constituted by racks 143*a* and 143*b* and a pinion gear 142 is used as the interrelating mechanism M1. In addition, a rack and pinion mechanism constituted by racks 145*a* and 145*b* and a pinion gear 144 is used as the interrelating mechanism M2.

As shown in FIG. 6, the blowing fans 15*a* and 15*b*, which move integrally with the side end guides 14*a* and 14*b*, are disposed inside in the sheet widthwise direction X with respect to the side end guides 14*a* and 14*b*. By this, it becomes possible to downsize the manual feeding portion 235 in the sheet widthwise direction X.

In the present Embodiment, the blowing fan 15*a* (first blowing fan) is different in a position with respect to the feeding direction Y from the blowing fan 15*b* (second blowing fan). By this, it becomes possible to make interference of the blowing fans 15*a* and 15*b* be less likely even when the side end guides 14*a* and 14*b* are moved in the sheet widthwise direction X, and it becomes possible for the side end guides 14*a* and 14*b* to regulate the sheet having a narrow width.

In particular, as shown in FIG. 7, when the side end guides 14*a* and 14*b* are moved to a position matching the sheet Sb of the smallest size, positions of the blowing fans 15*a* and 15*b* are overlapped as viewed in the feeding direction Y. In other words, in a state in which the first side end guide and the second side end guide are moved to the innermost position with respect to the sheet widthwise direction, the first blowing fan and the second blowing fan are overlapped as viewed in the feeding direction. By this, it becomes possible to deal with the sheet having a narrower width by utilizing the inner space of the feed tray 5 effectively.

In addition, as shown in FIG. 7, when the side end guides 14*a* and 14*b* are moved to the position matching the sheet Sb of the smallest size, the side end guide 14*a* on the front side overlaps the blowing fan 15*b* on the rear side as viewed from above. In addition, the side end guide 14*b* on the rear side overlaps the blowing fan 15*a* on the front side. In other words, in a state in which the first side end guide and the second side end guide are moved to the innermost position with respect to the sheet widthwise direction, the first side end guide and the second blowing fan are overlapped and the second side end guide and the first blowing fan are overlapped as viewed from above. By this, it becomes possible to deal with the sheet having a narrower width by utilizing the inner space of the feed tray 5 effectively.

As shown in FIG. 6, FIG. 7 and FIG. 10, the blowing fans 15*a* and 15*b* are guided by slide shafts 17*a* and 17*b* held by the feed tray 5, respectively. The slide shafts 17*a* and 17*b* are shaft-shaped members extending in the sheet widthwise direction X. The blowing fan 15*a* is provided with a fitting portion 15*a*3 fitting with the slide shaft 17*a*. The blowing fan 15*b* is provided with a fitting portion 15*b*3 fitting with the slide shaft 17*b*. By this, weights of the blowing fans 15*a* and 15*b* are supported by the slide shafts 17*a* and 17*b*, respectively, thereby improving operability of the side end guides 14*a* and 14*b*.

A position of the operating knob 18 provided on the side end guide 14*a* in the feeding direction Y and a position of the slide shaft 17*a* in the feeding direction Y may be overlapped. By this, it becomes less likely for a force in a rotational direction to be exerted to the side end guide with respect to the slide shaft 17*a* when the side end guide 14*a* is moved, thereby facilitating a smooth movement of the side end guide 14*a* and improving operability.

By the way, as shown in FIG. 6, while the rotation axis 15*a*1 of the blowing fan 15*a* of the front side is disposed near the blowing outlet 16*a*, the rotation axis 15*b*1 of the blowing fan 15*b* of the rear side is disposed upstream in the feeding direction Y away from the blowing outlet 16*b* of the side end guide 14*b*. In this case, the blowing fan 15*b* is disposed in a direction such that an exhaust port 15*b*2 is positioned downstream side of the feeding direction Y with respect to the rotation axis 15*b*1. By this, it becomes possible to reduce a pressure loss by shortening the air path from the exhaust port 15*b*2 to the blowing outlet 16*b* and it becomes possible to blow air onto the sheet efficiently.

As shown in FIG. 4(*a*) and FIG. 4(*b*), below the manual feeding portion 235, a door 601, which is an opening/closing member for carrying out a jam clearing process of the cassette feeding portion 230 (FIG. 1), is disposed. The door 601 is supported by a hinge 602 on the main assembly 201A of the image forming apparatus 201 (FIG. 1), and can rotate about a rotation axis extending in the sheet widthwise direction X. A locus 603 in the figure is a locus drawn by a tip of the door 601 (end portion of farther side from the hinge 602) when the door 601 is opened and closed.

In the present Embodiment, the bottom surface 5*b* of the feed tray 5 is provided with an inclined portion 5*c* formed in a tapered shape so as to become closer to the stacking surface 5*a* as it goes downstream in the feeding direction Y (see also FIG. 10). By this, it becomes possible for the blowing fans 15*a* and 15*b* having some thickness to be accommodated inside the feed tray 5 and to avoid interference with the door 601. Incidentally, as long as interference with the door 601 can be avoided, for example, the blowing fan 15*b* may be disposed at a position that overlaps the locus 603 as viewed in the sheet widthwise direction X but is different from the tip of the door 601 with respect to the sheet widthwise direction X.

Embodiment 2

Figure 11:
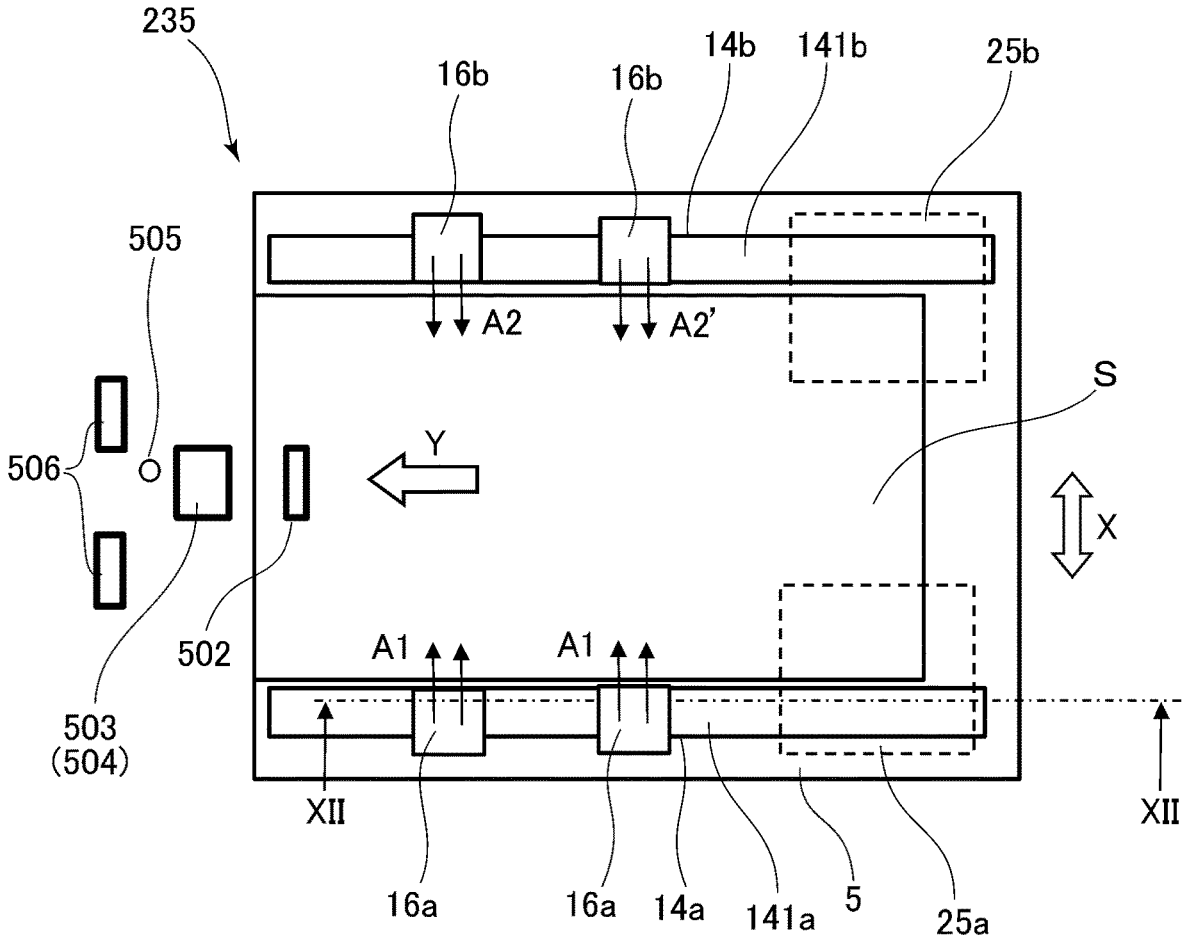
FIG. 11 is a schematic view of a manual feeding portion according to an Embodiment 2 as viewed from above.
Figure 12:
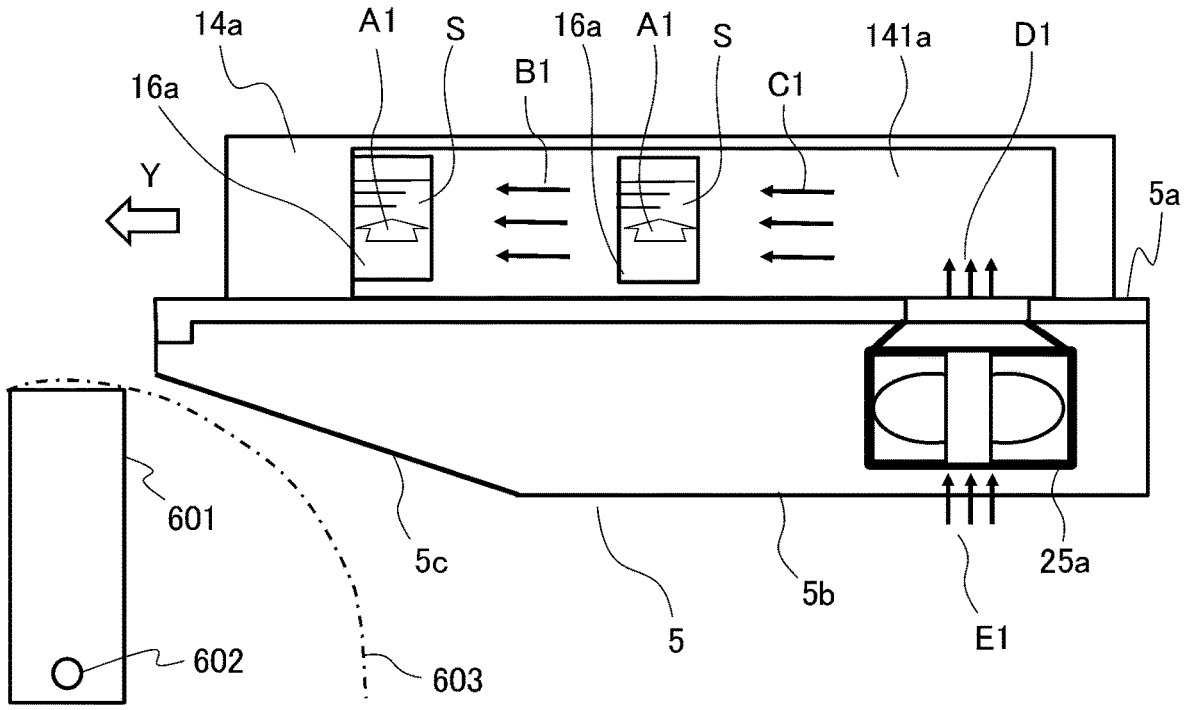
FIG. 12 is a schematic view illustrating a cross section of the manual feeding portion according to the Embodiment 2.

A manual feeding portion 235 according to an Embodiment 2 will be described using FIG. 11 and FIG. 12. FIG. 11 is a schematic view of the manual feeding portion 235 according to the present Embodiment as viewed from above. FIG. 12 is a cross section XII-XII of FIG. 11. Hereinafter, elements with common reference letters with the Embodiment 1 have substantially the same configurations and actions as those described in the Embodiment 1.

The present Embodiment differs from the Embodiment 1 in a point that an axial fan, which is relatively low cost, is used as the blowing fans 25*a* and 25*b*. In addition, the present Embodiment differs from the Embodiment 1 in a point that the blowing fans 25*a* and 25*b* are disposed near the end portion of the upstream side of the feed tray 5 with respect to the feeding direction Y, and the positions of the blowing fans 25*a* and 25*b* are overlapped as viewed in the sheet widthwise direction X.

The blowing fans 25*a* and 25*b* are disposed so that the rotation axis of the rotary blades (propeller) is crossed with the stacking surface 5*a* of the feed tray 5 (preferably, so as to be substantially parallel to the normal direction of the stacking surface 5*a*). Therefore, the blowing fans 25*a* and 25*b* suck outside air from below the feed tray 5 (stream line E1) and exhaust above toward the ducts 141*a* and 141*b* (stream line D1), respectively. And the air passes through the inside of the ducts 141*a* and 141*b* and is blown from the blowing outlets 16*a* and 16*b* to the side ends of the sheets.

Also in the present Embodiment, both blowing fans 25*a* and 25*b* are disposed below the stacking surface 5*a* of the feed tray 5 as the stacking member. Therefore, also by the present Embodiment, it becomes possible to save space in the configuration that blows air to the sheets.

Embodiment 3

Figure 13:
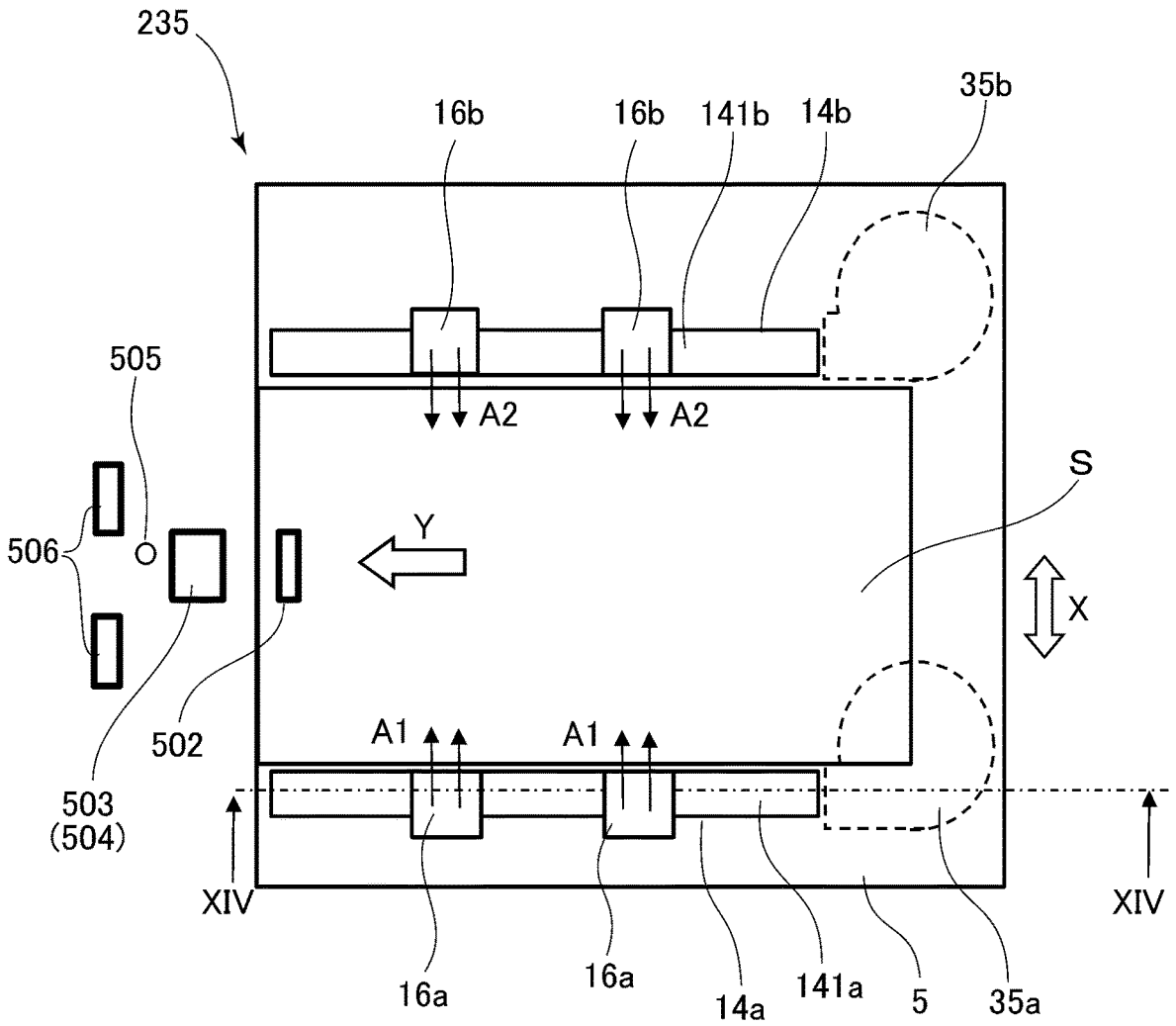
FIG. 13 is a schematic view of a manual feeding portion according to an Embodiment 3 as viewed from above.
Figure 14:
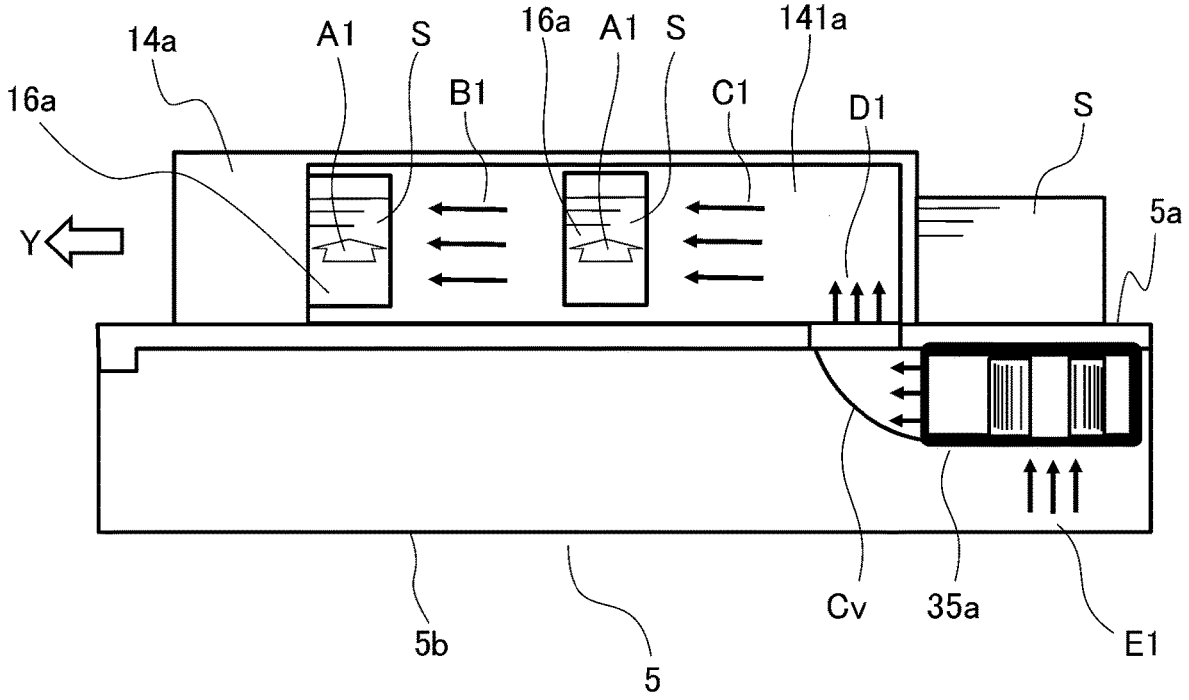
FIG. 14 is a schematic view illustrating a cross section of the manual feeding portion according to the Embodiment 3.

A manual feeding portion 235 according to an Embodiment 3 will be described using FIG. 13 and FIG. 14. FIG. 13 is a schematic view of the manual feeding portion 235 according to the present Embodiment as viewed from above. FIG. 14 is a cross section XIV-XIV of FIG. 13. Hereinafter, elements with common reference letters with the Embodiment 1 have substantially the same configurations and actions as those described in the Embodiment 1.

In the present Embodiment, sirocco fans with comparatively large air volume and yet with quietness and durability are used as blowing fans 35*a* and 35*b*. In addition, the present Embodiment differs from the Embodiment 1 in points that the blowing fans 35*a* and 35*b* are disposed near the end portion of the upstream side of the feed tray 5 with respect to the feeding direction Y, and the positions of the blowing fans 35*a* and 35*b* are overlapped as viewed in the sheet widthwise direction X.

The blowing fans 35*a* and 35*b* are disposed so that the rotation axis of the rotary blades (propeller) is crossed with the stacking surface 5*a* of the feed tray 5 (preferably, so as to be substantially parallel to the normal direction of the stacking surface 5*a*). The blowing fans 35*a* and 35*b* suck outside air from below the feed tray 5 (stream line E1) and exhaust in a direction along the stacking surface 5*a*. The ducts 141*a* and 141*b* are provided with curved portions Cv that guide the air exhausted from the blowing fans 35*a* and 35*b* in a direction along the stacking surface 5*a* toward above the stacking surface 5*a*, respectively. The air guided by the curved portions Cv (stream D1) passes through the inside of the ducts 141*a* and 141*b* and is blown from the blowing outlets 16*a* and 16*b* to the side ends of the sheets.

Also in the present Embodiment, both blowing fans 35*a* and 35*b* are disposed below the stacking surface 5*a* of the feed tray 5 as the stacking member. Therefore, also by the present Embodiment, it becomes possible to save space in the configuration that blows air to the sheets.

Embodiment 4

Figure 15:
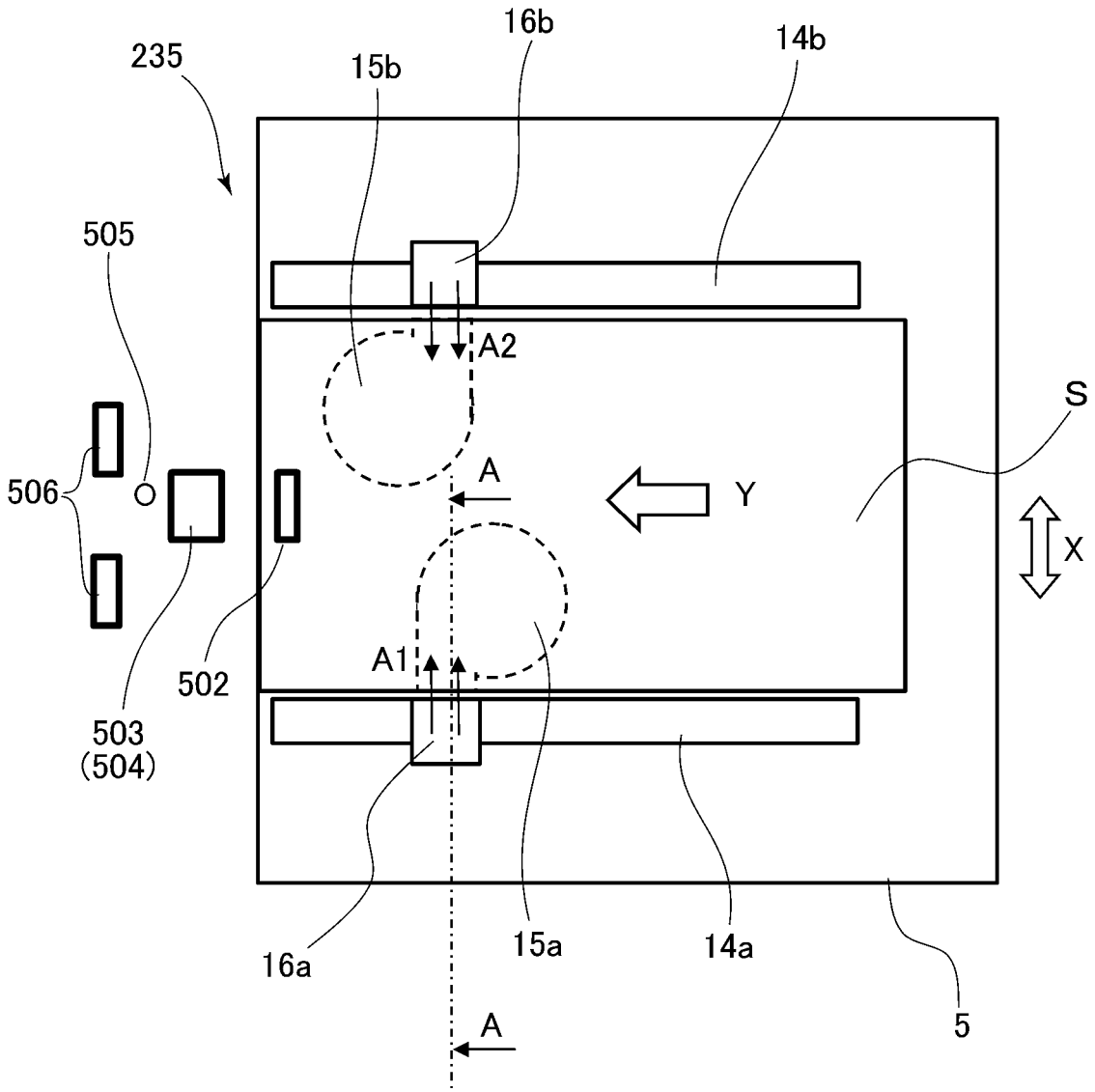
FIG. 15 is a schematic view of a manual feeding portion according to an Embodiment 4 as viewed from above.

A manual feeding portion 235 according to an Embodiment 4 is described using FIG. 15. FIG. 15 is a schematic view of the manual feeding portion 235 according to the present Embodiment as viewed from above. Hereinafter, elements with common reference letters with the Embodiment 1 have substantially the same configurations and actions as those described in the Embodiment 1.

The present Embodiment differs from the Embodiment 1 in a point that the blowing fans 15*a* and 15*b* are disposed so as to be facing each other in the sheet widthwise direction X. A cross-sectional view with respect to a cross section A-A of FIG. 15 is the same as FIG. 5 of the Embodiment 1. In addition, in the present Embodiment, the side end guide 14*a* is provided with the one blowing outlet 16*a* and the side end guide 14*b* is provided with the one blowing outlet 16*b*.

Even such an arrangement of the present Embodiment, it becomes possible to save space in the configuration that blows air to the sheets.

Embodiment 5

Figure 16:
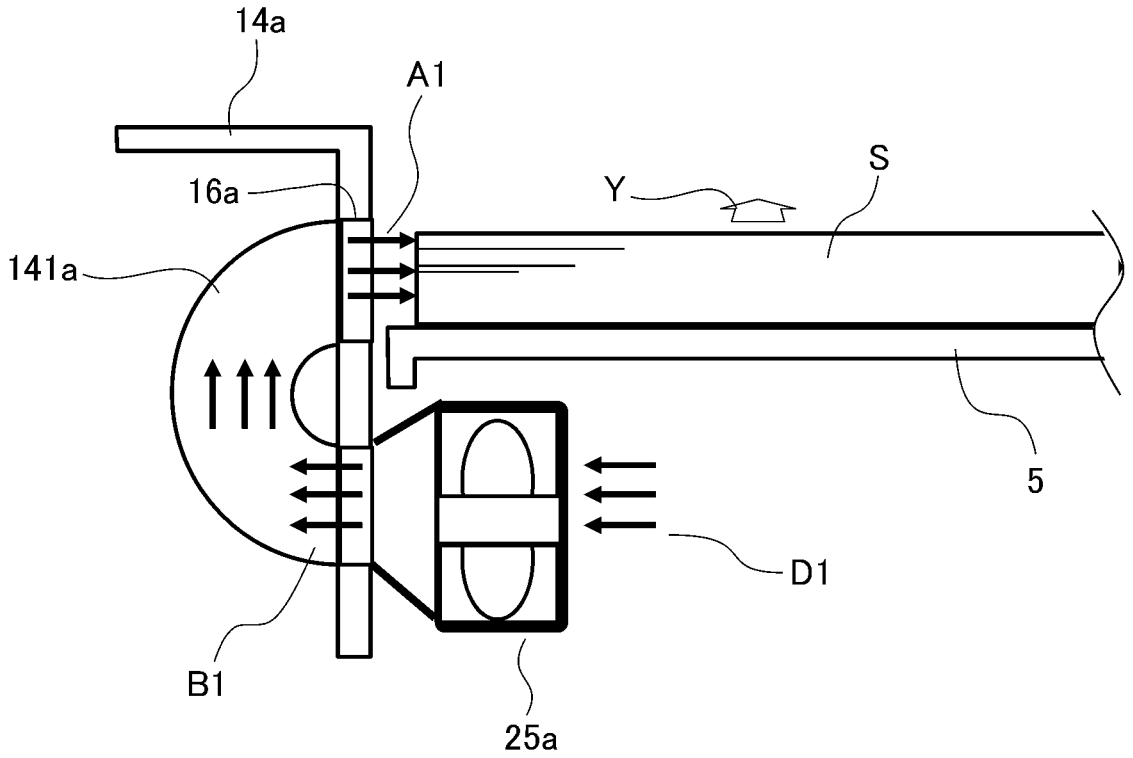
FIG. 16 is a schematic view illustrating a cross section of a manual feeding portion according to an Embodiment 5.

A manual feeding portion 235 according to an Embodiment 5 will be described using FIG. 16. FIG. 16 is a schematic view illustrating a cross section sectioning of the manual feeding portion 235 according to the present Embodiment with a plane perpendicular to the feeding direction Y. Hereinafter, elements with common reference letters with the Embodiment 1 have substantially the same configurations and actions as those described in the Embodiment 1.

In the present Embodiment, an axial fan is used as the blowing fan 25*a*, and the blowing fan 25*a* is disposed so that the rotation axis of the rotary blades (propeller) is along the sheet widthwise direction X (direction substantially perpendicular to the regulating surface 14*a*1 of the side end guide 14*a*).

The blowing fan 25*a* sucks air from inside with respect to the sheet widthwise direction X (stream line D1) and exhausts toward outside with respect to the sheet widthwise direction X (stream line B1). The air from the blowing fan 25*a* is blown, through the inside of the duct 141*a*, to the side end of the sheet from the blowing outlet 16*a* (stream line A1). Therefore, an exhausting direction of the blowing fan 25*a* and a blowing direction of the air from the blowing outlet 16*a* are opposite with respect to the sheet widthwise direction X. Therefore, also by this configuration, it becomes possible to save space in the sheet widthwise direction X.

According to the present Embodiment, it becomes possible for an occupied width of the blowing fan in the sheet widthwise direction X to be smaller than in cases where the blowing fan is disposed so that the rotation axis of the blowing fan is perpendicular to the stacking surface 5*a* of the feed tray 5. Therefore, it becomes possible to deal with the sheet having a narrower width by disposing the side end guides 14*a* and 14*b* closer to each other in the sheet widthwise direction X.

In addition, also in the present Embodiment, the blowing fan 25*a* is disposed below the stacking surface 5*a* of the feed tray 5 as the stacking member. Therefore, also by the present Embodiment, it becomes possible to save space in the configuration that blows air to the sheets.

Incidentally, although the one side end guide 14*a* and the blowing fan 25*a* are shown in FIG. 16, a blowing fan can be disposed in the same arrangement on the other side end guide 14*b*.

Embodiment 6

Figure 17:
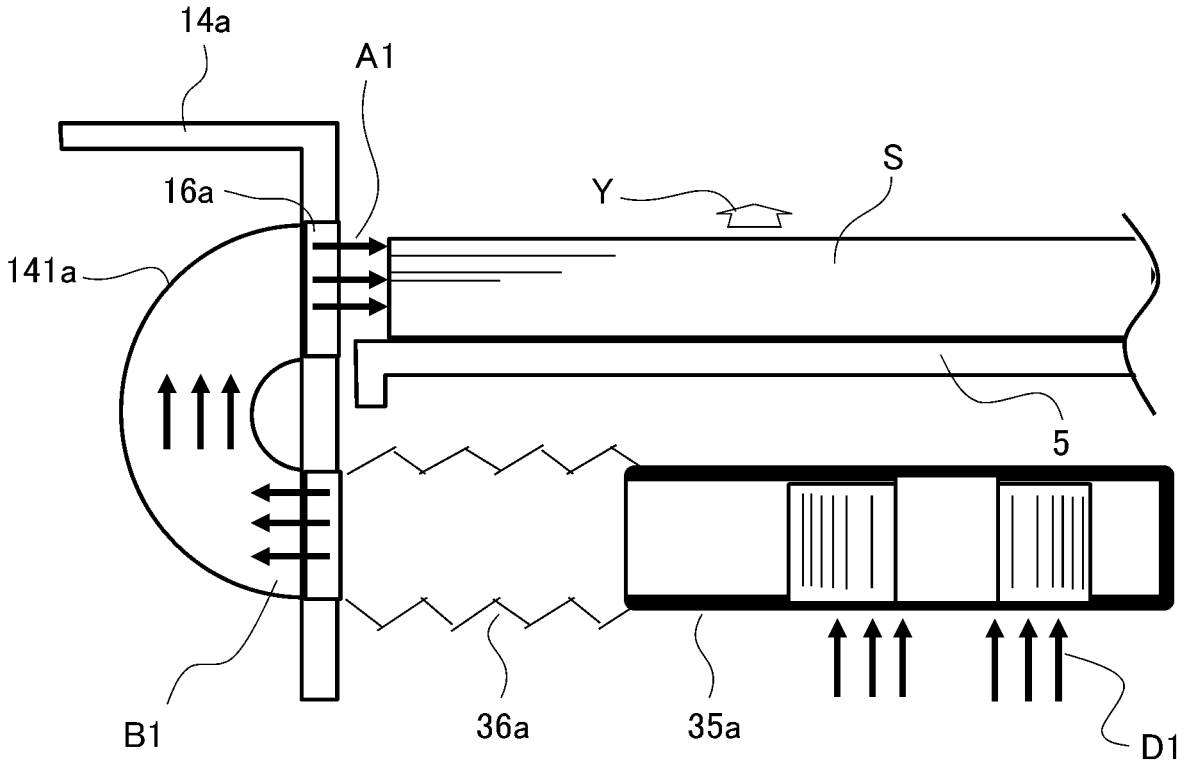
FIG. 17 is a schematic view illustrating a cross section of a manual feeding portion according to an Embodiment 6.

A manual feeding portion 235 according to an Embodiment 7 will be described using FIG. 17. FIG. 17 is a schematic view illustrating a cross section sectioning of the manual feeding portion 235 according to the present Embodiment with a plane perpendicular to the feeding direction Y. Hereinafter, elements with common reference letters with the Embodiment 1 have substantially the same configurations and actions as those described in the Embodiment 1.

In the present Embodiment, a sirocco fan is used as the blowing fan 35*a* and a position of the blowing fan 35*a* is fixed to the feed tray 5. An exhaust port of the blowing fan 35*a* is connected to the duct 141*a* disposed to the side end guide 14*a* via an extension/contraction duct 36*a* that can be extended and contracted in the sheet widthwise direction X.

The blowing fan 35*a* sucks air from below (stream line D1) and exhausts toward outside with respect to the sheet widthwise direction X. The air from the blowing fan 35*a* is blown, through the inside of the extension/contraction duct 36*a* and the duct 141*a* (stream line B1), to the side end of the sheets from the blowing outlet 16*a* (stream line A1). Therefore, an exhausting direction of the blowing fan 35*a* and a blowing direction of the air from the blowing outlet 16*a* are opposite with respect to the sheet widthwise direction X. Therefore, also by this configuration, it becomes possible to save space in the sheet widthwise direction X.

In addition, in the present Embodiment, it is unnecessary to move the blowing fan 35*a*, which is an electrical component and a heavy object, together with the side end guide 14*a*. By this, it becomes unnecessary to keep a margin in lengths of the power and signal lines to the blowing fan 35*a* for a movement, thereby simplifying a wiring path. In addition, since it is unnecessary to move the heavy object, an operating force required to move the side end guide 14*a* is reduced.

Incidentally, instead of a sirocco fan, an axial fan may be fixed to the feed tray 5.

Other Embodiments

In each of the Embodiments described above, the one side end guide 14*a* is provided with the two blowing outlets 16*a*. An amount of the air blown from each of the blowing outlets 16*a* may be equal, or the amount of the one may be larger than that of the other. In addition, an air blowing may be turned ON or OFF according to the type and the size of the sheet. For example, only in cases where the size of the sheet is larger than a predetermined size, the blowing fan may be actuated and the air blowing may be turned ON. A number of blowing outlets 16*a* may be one per side end guide 14*a*, or three or more per side end guide 14*a*.

In each of the Embodiments described above, configurations provided with the blowing fans corresponding to each of the pair of the side end guides 14*a* and 14*b* are described as examples. Not limited to this, the blowing fan may be disposed on only one side of the side end guides.

In each of the Embodiments described above, configurations in which the stacking surface 5*a* of the feed tray 5 is not raised and lowered but the pickup roller 502 is raised and lowered (so-called lifterless configuration) are described as examples, but the stacking member that supports the sheets may be raised and lowered. For example, in the cassette 1 (FIG. 1), a supporting plate (middle plate) that is swingable with respect to the bottom portion of cassette 1 and a lifter plate that raises and lowers the supporting plate may be disposed. In addition, in a sheet feed apparatus provided with an accommodating storage having a larger capacity, a lifter mechanism may be used to raise and lower vertically the support plate suspended on a wire by winding and unwinding the wire.

In addition, in each of the Embodiments described above, the manual sheet feed apparatus disposed in a side surface portion of the image forming apparatus used mainly in an office is described. Not limited to this, the present art may be applied to the cassette feeding portion 230 (FIG. 1). In addition, the present art may be applied to a sheet feed apparatus of a manual feed type or a sheet feed apparatus used with connecting to the main assembly of the image forming apparatus (optional feeder) in a larger image forming apparatus for commercial use.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2022-088746 filed on May 31, 2022 and 2023-058759 filed on Mar. 31, 2023, which are hereby incorporated by reference herein in their entirety.

What is claimed is:

1. An image forming apparatus comprising:

an image forming portion configured to form an image on a sheet;

a tray provided on a main assembly accommodating the image forming portion and including a stacking surface on which the sheet is stacked;

a feeding portion configured to feed the sheet stacked on the stacking surface toward the image forming portion;

a side end regulate portion configured to regulate a side end of the sheet stacked on the stacking surface with respect to a sheet widthwise direction perpendicular to a sheet feeding direction; and a blowing fan mounted on the tray and configured to generate air blown to the side end of the sheet with respect to the sheet widthwise direction, wherein the blowing fan is disposed on an opposite side to a side where the sheet is stacked on the stacking surface so that at least a part of the blowing fan with respect to the sheet widthwise direction is overlapped with the stacking surface with respect to the sheet widthwise direction, and wherein the blowing fan moves with the side end regulate portion in the sheet widthwise direction.

2. An image forming apparatus according to claim 1, wherein as viewed in a direction perpendicular to the stacking surface of the tray, at least the part of the blowing fan is overlapped with the stacking surface.

3. An image forming apparatus according to claim 1, wherein the blowing fan is accommodated in an inner space of the tray expanding between the stacking surface and a bottom surface of the tray.

4. An image forming apparatus according to claim 1, wherein the side end regulate portion includes a blowing outlet configured to blow the air from the blowing fan to the side end of the sheet stacked on the stacking surface.

5. An image forming apparatus according to claim 4, wherein the blowing fan is disposed so that an exhausting direction faces outside with respect to the sheet widthwise direction, and wherein the blowing outlet is disposed so that a blowing direction of the air faces inside with respect to the sheet widthwise direction.

6. An image forming apparatus according to claim 5, wherein the blowing fan includes a rotary blade, is a centrifugal fan which sucks from one side of an axial direction of the rotary blade and exhausts in a direction perpendicular to the axial direction, and is disposed so that the axial direction crosses the stacking surface.

7. An image forming apparatus according to claim 6, wherein the side end regulate portion is provided with a regulating surface opposite to an end portion of the sheet with respect to the sheet widthwise direction, and wherein an entire rotary blade is positioned inside the regulating surface with respect to the sheet widthwise direction.

8. An image forming apparatus according to claim 4, wherein where the side end regulate portion is a first side end guide and the blowing fan is a first blowing fan, the image forming apparatus further comprises:

a second side end guide disposed opposite to the first side end guide with respect to the sheet widthwise direction and that moves in interrelation with the first side end guide; and a second blowing fan moving with the second side end guide in the sheet widthwise direction, and configured to blow the air to the sheet via a blowing outlet provided on the second side end guide.

9. An image forming apparatus according to claim 8, wherein the first blowing fan is different in a position with respect to the feeding direction from the second blowing fan.

10. An image forming apparatus according to claim 9, wherein in a state in which the first side end guide and the second side end guide are moved to the innermost position with respect to the sheet widthwise direction, the first blowing fan and the second blowing fan are overlapped as viewed in a feeding direction.

11. An image forming apparatus according to claim 10, wherein in a state in which the first side end guide and the second side end guide are moved to the innermost position with respect to the sheet widthwise direction, the first side end guide and the second blowing fan are overlapped and the second side end guide and the first blowing fan are overlapped as viewed from above.

12. An image forming apparatus according to claim 9, wherein the side end regulate portion includes a duct configured to guide the air from the blowing fan to the blowing outlet, and wherein the tray is provided with an opening portion configured to penetrate from a downside of the tray to an upside of the tray and permit movement of the duct in a case in which the side end regulate portion moves in the sheet widthwise direction.

13. An image forming apparatus according to claim 4, wherein the blowing fan is constituted to suck outside air via a sucking inlet provided in a bottom surface of the tray, and wherein the sucking inlet extends in the sheet widthwise direction so that a state that at least a part of an opening of a suction side of the blowing fan is opposite to the sucking inlet is maintained in a case in which the side end regulate portion moves from one end of a moving range of the side end regulate portion to the other end.

14. An image forming apparatus according to claim 4, wherein the side end regulate portion includes a second blowing outlet away from the blowing outlet in the feeding direction and a duct extending in the feeding direction so as to guide the air from the blowing fan to the blowing outlet and the second blowing outlet.

15. An image forming apparatus according to claim 4, wherein the blowing fan is disposed on an upstream side of the side end regulate portion with respect to the feeding direction.

16. An image forming apparatus according to claim 1, wherein the blowing fan is a sirocco fan.

17. An image forming apparatus according to claim 1, wherein the blowing fan is an axial fan.

18. An image forming apparatus according to claim 1, wherein at least a part of the blowing fan is overlapped with the stacking surface with respect to the sheet widthwise direction when the side end regulate portion is moved in the widthwise direction.

19. An image forming apparatus according to claim 1, wherein at least a part of the blowing fan is overlapped with the stacking surface with respect to the sheet widthwise direction when the side end regulate portion is moved to the outermost position and the innermost position in the widthwise direction.

20. An image forming apparatus according to claim 1, wherein a tray is rotatably provided on the main assembly accommodating the image forming portion.

21. An image forming apparatus according to claim 1, wherein the blowing fan moves integrally with the side end regulate portion in the sheet widthwise direction.

22. An image forming apparatus comprising:

an image forming portion configured to form an image on a sheet;

a tray provided on a main assembly accommodating the image forming portion and including a stacking surface on which the sheet is stacked;

a feeding portion configured to feed the sheet stacked on the stacking surface toward the image forming portion;

a side end regulate portion configured to regulate a side end of the sheet stacked on the stacking surface with respect to a sheet widthwise direction perpendicular to a sheet feeding direction; and a blowing fan mounted on the tray and configured to generate air blown to the side end of the sheet with respect to the sheet widthwise direction, wherein the blowing fan is disposed on an opposite side to a side where the sheet is stacked on the stacking surface so that the blowing fan with respect to the sheet widthwise direction is overlapped with the tray with respect to the sheet widthwise direction, and wherein the blowing fan moves with the side end regulate portion in the sheet widthwise direction.

23. An image forming apparatus according to claim 22, wherein as viewed in a direction perpendicular to the stacking surface of the tray, the blowing fan is overlapped with the tray.

24. An image forming apparatus according to claim 22, wherein the blowing fan is accommodated in an inner space of the tray expanding between the stacking surface and a bottom surface of the tray.

25. An forming apparatus according to claim 22, wherein the side end regulate portion includes a blowing outlet configured to blow the air from the blowing fan to the side end of the sheet stacked on the stacking surface.

26. An image forming apparatus according to claim 25, wherein the blowing fan is disposed so that an exhausting direction faces outside with respect to the sheet widthwise direction, and wherein the blowing outlet is disposed so that a blowing direction of the air faces inside with respect to the sheet widthwise direction.

27. An image forming apparatus according to claim 26, wherein the blowing fan includes a rotary blade, is a centrifugal fan which sucks from one side of an axial direction of the rotary blade and exhausts in a direction perpendicular to the axial direction, and is disposed so that the axial direction crosses the stacking surface.

28. An image forming apparatus according to claim 27, wherein the side end regulate portion is provided with a regulating surface opposite to an end portion of the sheet with respect to the sheet widthwise direction, and wherein an entire rotary blade is positioned inside the regulating surface with respect to the sheet widthwise direction.

29. An image forming apparatus according to claim 25, wherein where the side end regulate portion is a first side end guide and the blowing fan is a first blowing fan, the image forming apparatus further comprises:

a second side end guide disposed opposite to the first side end guide with respect to the sheet widthwise direction and that moves in interrelation with the first side end guide; and a second blowing fan moving with the second side end guide in the sheet widthwise direction, and configured to blow the air to the sheet via a blowing outlet provided on the second side end guide.

30. An image forming apparatus according to claim 29, wherein when the first blowing fan is different in a position with respect to the feeding direction from the second blowing fan.

31. An image forming apparatus according to claim 30, wherein in a state in which the first side end guide and the second side end guide are moved to the innermost position with respect to the sheet widthwise direction, the first blowing fan and the second blowing fan are overlapped as viewed in a feeding direction.

32. An image forming apparatus according to claim 30, wherein in a state in which the first side end guide and the second side end guide are moved to the innermost position with respect to the sheet widthwise direction, the first side end guide and the second blowing fan are overlapped and the second side end guide and the first blowing fan are overlapped as viewed from above.

33. An image forming apparatus according to claim 30, wherein the side end regulate portion includes a duct configured to guide the air from the blowing fan to the blowing outlet, and wherein the tray is provided with an opening portion configured to penetrate from a downside of the tray to an upside of the tray and permit movement of the duct in a case in which the side end regulate portion moves in the sheet widthwise direction.

34. An image forming apparatus according to claim 25, wherein the blowing fan is constituted to suck outside air via a sucking inlet provided in a bottom surface of the tray, and wherein the sucking inlet extends in the sheet widthwise direction so that a state that at least a part of an opening of a suction side of the blowing fan is opposite to the sucking inlet is maintained in a case in which the side end regulate portion moves from one end of a moving range of the side end regulate portion to the other end.

35. An image forming apparatus according to claim 25, wherein the side end regulate portion includes a second blowing outlet away from the blowing outlet in the feeding direction and a duct extending in the feeding direction so as to guide the air from the blowing fan to the blowing outlet and the second blowing outlet.

36. An image forming apparatus according to claim 25, wherein the blowing fan is disposed on an upstream side of the side end regulate portion with respect to the feeding direction.

37. An image forming apparatus according to claim 22, wherein at least a part of the blowing fan is overlapped with the stacking surface with respect to the sheet widthwise direction when the side end regulate portion is moved in the widthwise direction.

38. An image forming apparatus according to claim 22, wherein at least a part of the blowing fan is overlapped with the stacking surface with respect to the sheet widthwise direction when the side end regulate portion is moved to the outermost position and the innermost position in the widthwise direction.

39. An image forming apparatus according to claim 22, wherein a tray is rotatably provided on the main assembly accommodating the image forming portion.

40. An image forming apparatus according to claim 22, wherein the blowing fan moves integrally with the side end regulate portion in the sheet widthwise direction.

* * * * *